US009563138B2

(12) United States Patent
Iwasaki

(10) Patent No.: US 9,563,138 B2
(45) Date of Patent: Feb. 7, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Masahiro Iwasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/812,502

(22) Filed: Jul. 29, 2015

(65) Prior Publication Data

US 2016/0238955 A1 Aug. 18, 2016

(30) Foreign Application Priority Data

Feb. 13, 2015 (JP) ..... 2015-026759

(51) Int. Cl.
*G03G 5/00* (2006.01)
*G03G 5/06* (2006.01)

(52) U.S. Cl.
CPC ..... *G03G 5/0618* (2013.01); *G03G 5/0609* (2013.01)

(58) Field of Classification Search
CPC ..... G03G 5/0618; G03G 5/0609
(Continued)

(56) References Cited

U.S. PATENT DOCUMENTS 5,977,389 A 11/1999 Okada et al.
6,485,873 B1 11/2002 Ohkura et al.
(Continued)

FOREIGN PATENT DOCUMENTS

JP H04-285670 A 10/1992
JP H05-25136 A 2/1993
(Continued)

*Primary Examiner* — Mark A Chapman

(74) *Attorney, Agent, or Firm* — Oliff PLC

(57) ABSTRACT

An electrophotographic photoreceptor includes a single layer type photosensitive layer which includes a binder resin, a charge generating material, a hole transport material, a first electron transport material represented by the formula (1), and a second electron transport material represented by the formula (2), (1)

wherein $X^1$ represents an oxygen atom or $=C(CN)_2$; $R^{11}$ to $R^{17}$ independently represents a hydrogen atom, a halogen atom, an alkyl group, an alkoxy group, an aryl group, or an aralkyl group; and $R^{18}$ represents an alkyl group, $-L^{111}-O-R^{112}$, an aryl group, or an aralkyl group; provided that $L^{111}$ represents an alkylene group, and $R^{112}$ represents an alkyl group, (2)

(Continued)

SYNTHESIS EXAMPLE 2 : INFRARED ABSORPTION SPECTRUM OF EXEMPLARY COMPOUND (2-7)

wherein $X^2$ represents an oxygen atom or $=C(CN)_2$; $R^{21}$ to $R^{27}$ independently represents a hydrogen atom, a halogen atom, an alkyl group, an alkoxy group, an aryl group or an aralkyl group; and $R^{28}$ represents an alkylene group having 4 to 20 carbon atoms or the like.

14 Claims, 5 Drawing Sheets

(58) Field of Classification Search
USPC ..... 430/38.35, 58.35
See application file for complete search history.

(56) References Cited

U.S. PATENT DOCUMENTS

| | | | | |
|---|---|---|---|---|
| 2005/0164106 | A1 | 7/2005 | Bender et al. | |
| 2005/0175913 | A1* | 8/2005 | Bender ..... | G03G 5/0578 430/64 |

FOREIGN PATENT DOCUMENTS

| | | | |
|---|---|---|---|
| JP | H05-25174 | A | 2/1993 |
| JP | H09-43876 | A | 2/1997 |
| JP | H09-265198 | A | 10/1997 |
| JP | H10-251206 | A | 9/1998 |
| JP | 2000-314969 | A | 11/2000 |
| JP | 2001-242656 | A | 9/2001 |
| JP | 3445913 | B2 | 9/2003 |
| JP | 2005-215677 | A | 8/2005 |

* cited by examiner

SYNTHESIS EXAMPLE 1 : INFRARED ABSORPTION SPECTRUM OF EXEMPLARY COMPOUND (2-23)

SYNTHESIS EXAMPLE 2 : INFRARED ABSORPTION SPECTRUM OF EXEMPLARY COMPOUND (2-7)

SYNTHESIS EXAMPLE 3 : INFRARED ABSORPTION SPECTRUM OF EXEMPLARY COMPOUND (2-19)

FIGURE. ENTHALPY RELAXATION BEFORE AND AFTER EVALUATION OF PHOTORECEPTORS

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-026759 filed Feb. 13, 2015.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor including:

a conductive substrate; and a photosensitive layer that is a single layer type photosensitive layer provided on the conductive substrate, wherein the photosensitive layer includes a binder resin, a charge generating material, a hole transport material, a first electron transport material represented by the formula (1), and a second electron transport material represented by the formula (2), (1)

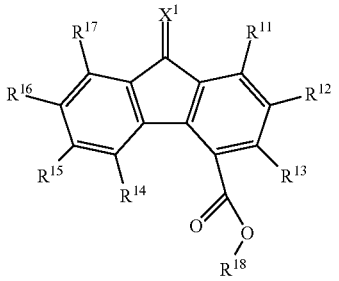

wherein $X^1$ represents an oxygen atom or $=C(CN)_2$; each of $R^{11}$, $R^{12}$, $R^{13}$, $R^{14}$, $R^{15}$, $R^{16}$, and $R^{17}$ independently represents a hydrogen atom, a halogen atom, an alkyl group, an alkoxy group, an aryl group, or an aralkyl group; and $R^{18}$ represents an alkyl group, $-L^{111}-O-R^{112}$, an aryl group, or an aralkyl group; provided that $L^{111}$ represents an alkylene group, and $R^{112}$ represents an alkyl group, (2)

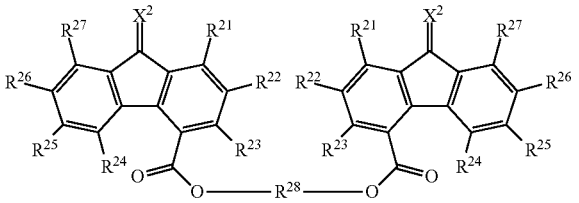

wherein $X^2$ represents an oxygen atom or $=C(CN)_2$; each of $R^{21}$, $R^{22}$, $R^{23}$, $R^{24}$, $R^{25}$, $R^{26}$, and $R^{27}$ independently represents a hydrogen atom, a halogen atom, an alkyl group, an alkoxy group, an aryl group or an aralkyl group; and $R^{28}$ represents an alkylene group having 4 to 20 carbon atoms or $-(L^{221}-O-L^{221})_n-$; provided that $L^{221}$ each independently represents an alkylene group having 1 to 4 carbon atoms and n represents an integer of 1 to 10.

BRIEF DESCRIPTION OF THE DRAWINGS

Exemplary embodiments of the present invention will be described in detail based on the following figures, wherein.

DETAILED DESCRIPTION

Figure 1:
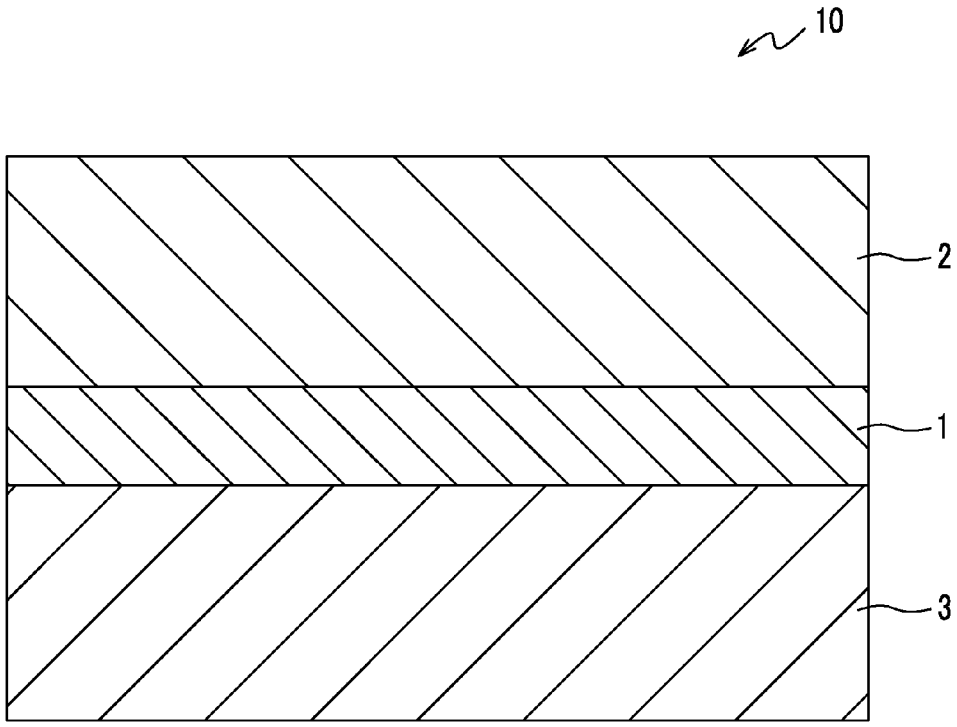
FIG. 1 is a schematic partial cross-sectional view showing an electrophotographic photoreceptor according to the present exemplary embodiment.

Hereinafter, the exemplary embodiments of the invention will be described in detail.

[Electrophotographic Photoreceptor]

An electrophotographic photoreceptor according to the present exemplary embodiment (hereinafter, in some cases, referred to as "photoreceptor") is a positively-charged organic photoreceptor including a conductive substrate and a single layer type photosensitive layer on the conductive substrate (hereinafter, in some cases, referred to as "single layer type photoreceptor").

In addition, the single layer type photosensitive layer (hereinafter, in some cases, simply referred to as "photosensitive layer") contains a binder resin, a charge generating material, a hole transport material, a first electron transport material represented by the formula (1) (hereinafter, in some cases, simply referred to as "first electron transport material"), and a second electron transport material represented by the formula (2) (hereinafter, in some cases, simply referred to as "second electron transport material").

Furthermore, the single layer type photosensitive layer refers to a photosensitive layer having hole-transporting properties and electron-transporting properties together with charge generating ability.

In the present exemplary embodiment, the single layer type photosensitive layer includes the first electron transport material and the second electron transport material. Therefore, it is possible to obtain a photoreceptor in which it is more difficult for a morphological change to occur in the photosensitive layer compared with a case in which only the first electron transport material is contained in the photosensitive layer as an electron transport material. The reasons therefor are not certain, but are assumed as described below.

Generally, a fluorenone derivative (compound having a fluorenone skeleton) is an excellent electron transport material since the fluorenone derivative has high electron mobility and a property of easily receiving electrons from a charge generating material such as a phthalocyanine compound. However, when only the fluorenone derivative is contained in the photosensitive layer as the electron transport material, a morphological change easily occurs in the photosensitive layer. Specifically, while images are repeatedly formed, there are cases in which thermal diffusion and the like occur in the photosensitive layer and the fluorenone derivative moves in the photosensitive layer. When the fluorenone derivative moves in the photosensitive layer, there are cases in which cracks are generated in the surface of the photosensitive layer or it becomes difficult to maintain electrical characteristics immediately after the production of the photoreceptor due to the diffusion or agglomeration of the fluorenone derivative. The movement of the fluorenone derivative in the photosensitive layer caused by the thermal diffusion and the like is considered to occur since the molecular weight of the fluorenone derivative is small.

On the other hand, for example, as a compound represented by the formula (2), a compound obtained by dimerizing the fluorenone derivatives as monomers (a dimer of the fluorenone derivatives (a compound having a fluorenone skeleton)) has a high molecular weight. Therefore, when a dimer of the fluorenone derivatives is singly contained in the photosensitive layer as the electron transport material, it becomes difficult for thermal diffusion to occur in the photosensitive layer. However, since a number of the dimers of the fluorenone derivatives have a low solubility in a resin, in the case where the dimer of the fluorenone derivatives is singly used, there are cases in which it is difficult to form a film. In addition, even when the film formation is possible, there are cases in which the crystals of the dimer of the fluorenone derivatives are precipitated over time and a morphological change occurs in the photosensitive layer.

On the contrary, in the present exemplary embodiment, the first electron transport material represented by the formula (1) which is a monomer of the fluorenone derivative and the second electron transport material represented by the formula (2) which is a dimer of the fluorenone derivatives are jointly used as the electron transport materials and thus the movement of the monomer of the fluorenone derivative caused by thermal diffusion is prevented. This phenomenon is considered to occur since the joint use of the monomer of the fluorenone derivative and the dimer of the fluorenone derivatives makes the dimer of the fluorenone derivatives exhibit an anchor effect and thus the movement of the monomer of the fluorenone derivative is prevented. In addition, it is considered that, since the use of the dimer of the fluorenone derivatives increases the glass transition temperature of the photosensitive layer and improves the thermal stability of the photosensitive layer, the occurrence of thermal diffusion is prevented. Further, due to the joint use of the first electron transport material and the second electron transport material, the solubility of the electron transport material in a resin may be maintained and thus it is possible to form the photosensitive layer in which the occurrence of precipitation is prevented over a long period of time.

From what has been described above, it is assumed that, in the electrophotographic photoreceptor of the present exemplary embodiment, due to the synergetic effect of the use of the first electron transport material and the second electron transport material, the agglomeration or diffusion of the electron transport materials in the photosensitive layer is prevented even when images are repeatedly formed and it becomes difficult for a morphological change to occur in the photosensitive layer.

Furthermore, in the electrophotographic photoreceptor of the present exemplary embodiment in which the first electron transport material and the second electron transport material are jointly used, even when images are repeatedly formed, the charging durability is favorable and the occurrence of defects in terms of image qualities such as black spots may be prevented.

Hereinafter, the electrophotographic photoreceptor according to the present exemplary embodiment will be described in detail with reference to the drawings.

FIG. 1 schematically shows a cross-sectional view showing a part of the electrophotographic photoreceptor 10 according to the present exemplary embodiment.

The electrophotographic photoreceptor 10 shown in FIG. 1 includes a conductive and has a structure in which an undercoat layer 1 and a single layer type photosensitive layer 2 are provided in this order on the conductive substrate 3.

Further, the undercoat layer 1 is a layer which is provided, as desired. That is, the single layer type photosensitive layer 2 may be provided directly or through the undercoat layer 1 on the conductive substrate 3.

Further, other layers may be provided, as desired. Specifically, for example, a protective layer may be provided on a single layer type photosensitive layer 2, as desired.

(Conductive Substrate)

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm sequentially to prevent interference fringes which are formed when irradiated with laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

Examples of the method for surface roughening include wet-type honing in which an abrading agent is suspended in water and is blown onto the conductive substrate, centerless grinding in which the conductive substrate is pressed onto a rotating grinding stone and grinding work is continuously carried out, anodic oxidation, and the like.

Other examples of the method for surface roughening include a method for surface roughening by forming a layer of a resin in which conductive or semiconductive particles are dispersed on the surface of a conductive substrate so that the surface roughening is achieved by particles dispersed in the layer, while not roughening the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation as it is chemically active, easily contaminated and has a large resistance variation depending on the environment. Therefore, it is preferable to conduct a sealing treatment in which for a porous anodic oxide film, fine pores of the oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The conductive substrate may be subjected to a treatment with an acidic treatment solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, a ratio such that from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness of the film is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

(Undercoat Layer)

The undercoat layer is, for example, a layer including inorganic particles and a binder resin.

Examples of the inorganic particles include inorganic particles having powder resistance (volume resistivity) of $10^2$ Ωcm to $10^{11}$ Ωcm.

Among these, as the inorganic particles having the resistance values above, metal oxide particles such as tin oxide particles, titanium oxide particles, zinc oxide particles, and zirconium oxide particles are preferable, and zinc oxide particles are particularly preferable.

The specific surface area of the inorganic particles as measured by a BET method is, for example, preferably 10 $m^2/g$ or more.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binder resin.

The inorganic particles may be the ones which have been subjected to a surface treatment. The inorganic particles which have been subjected to different surface treatments or have different particle diameters may be used in combination of two or more kinds thereof.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either a dry method or a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transport materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The dropwise addition or spraying of the electron acceptive compound is preferably carried out at a temperature no higher than the boiling point of the solvent. After the dropwise addition or spraying of the electron acceptive compound, the inorganic particles may further be subjected to baking at a temperature of 100° C. or higher. The baking may be carried out at any temperature and time without limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and time without limitation, in which desired electrophotographic characteristics may be obtained. In the wet method, the moisture contained in the inorganic particles may be removed prior to the addition of an electron acceptive compound, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binder resin used in the undercoat layer include known materials, such as well-known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binder resin used in the undercoat layer include charge transport resins having charge transport groups, and conductive resins (for example, polyaniline).

Among these, as the binder resin used in the undercoat layer, a resin which is insoluble in a coating solvent of an upper layer is suitable, and particularly, resins obtained by reacting a curing agent and at least one kind of resin selected from the group consisting of thermosetting resins such as urea resins, phenol resins, phenol-formaldehyde resins, melamine resins, urethane resins, unsaturated polyester resins, alkyd resins, and epoxy resins; and polyamide resins, polyester resins, polyether resins, methacrylic resins, acrylic resins, polyvinyl alcohol resins, and polyvinyl acetal resins with curing agents are suitable.

In the case where these binder resins are used in combination of two or more kinds thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transport pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used alone, or as a mixture or a polycondensate of plural compounds.

The Vickers hardness of the undercoat layer is preferably 35 or more.

The surface roughness (ten point height of irregularities) of the undercoat layer is adjusted in the range of from (¼) $n\lambda$ to (½)$\lambda$, in which $\lambda$ represents the wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and crosslinked polymethyl methacrylate resin particles. In addition, the surface of the undercoat layer may be polished in order to adjust the surface roughness. Examples of the polishing method include buff polishing, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming an undercoat layer include known organic solvents, such as alcohol solvents, aromatic hydrocarbon solvents, hydrocarbon halide solvents, ketone solvents, ketone alcohol solvents, ether solvents, and ester solvents.

Specific examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

Examples of a method for applying the coating liquid for forming an undercoat layer onto the conductive substrate include ordinary methods such as a blade coating method, a wire bar coating method, a spray coating method, a dipping coating method, a bead coating method, an air knife coating method, and a curtain coating method.

The film thickness of the undercoat layer is set to a range of, for example, preferably 15 μm or more, and more preferably from 20 μm to 50 μm.

(Intermediate Layer)

Although not shown in the figures, an intermediate layer may be provided between the undercoat layer and the photosensitive layer.

The intermediate layer is, for example, a layer including a resin. Examples of the resin used in the intermediate layer include polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organometallic compound. Examples of the organometallic compound used in the intermediate layer include organometallic compounds containing a metal atom such as zirconium, titanium, aluminum, manganese, and silicon.

These compounds used in the intermediate layer may be used alone or as a mixture or a polycondensate of plural compounds.

Among these, the intermediate layer is preferably a layer including organometallic compounds containing a zirconium atom or a silicon atom.

The formation of the intermediate layer is not particularly limited, and well-known forming methods are used. For example, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spray coating method, a blade coating method, a knife coating method, and a curtain coating method are used.

The film thickness of the intermediate layer is set to, for example, preferably a range of 0.1 μm to 3 μm. Further, the intermediate layer may be used as an undercoat layer.

(Single layer Type Photosensitive Layer)

The single layer type photosensitive layer of the present exemplary embodiment may include a binder resin, a charge generating material, a hole transport material, and the first and second electron transport materials and include other additives, as desired.

—Binder Resin—

The binder resin is not particularly limited, and examples thereof include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinyl carbazole, and polysilane. These binder resins may be used alone or as a mixture of two or more kinds thereof.

Among these binder resins, from the viewpoint of the solubilities of the first electron transport material and the second electron transport material in the binder resin and the like, particularly, polycarbonate resins and polyarylate resins are preferable.

Further, from the viewpoint of a photosensitive layer forming property, as the binder resin, for example, polycarbonate resins having a viscosity average molecular weight of 30,000 to 80,000 and polyarylate resins having a viscosity average molecular weight of 30,000 to 80,000 are preferable.

Further, the viscosity average molecular weight is measured as follows. Specifically, 1 g of a resin is dissolved in 100 $cm^3$ of methylene chloride, and the specific viscosity ηsp is measured under the measurement condition of 25° C. using an Ubbellohde's viscometer. Further, an intrinsic viscosity (η) ($cm^3/g$) is determined from a relationship equation of $\eta sp/c=(\eta)+0.45(\eta)^2c$ (in which c is a concentration ($g/cm^3$)) Further, a viscosity average molecular weight Mv is determined from an equation given by H. Schnell, $(\eta)=1.23\times10^{-4}$ Mv0.83. As such, for measurement of the viscosity average molecular weight, for example, a one-point measurement method is used.

The content of the binder resin based on the total solid content of the photosensitive layer is, for example, from 35% by weight to 60% by weight, and preferably from 40% by weight to 55% by weight.

—Charge Generating Material—

Examples of the charge generating material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these, in order to correspond to laser exposure in the near-infrared region, it is preferable to use metal or metal-free phthalocyanine pigments as the charge generating material, and specifically, hydroxygallium phthalocyanine, chlorogallium phthalocyanine, dichlorotin phthalocyanine, and titanyl phthalocyanine are more preferable.

On the other hand, in order to correspond to laser exposure in the near-ultraviolet region, as the charge generating material, condensed aromatic pigments such as dibromoanthanthrone; thioindigo pigments; porphyrazine compounds; zinc oxides; trigonal selenium; bisazo pigments; and the like are preferable.

That is, as the charge generating material, an inorganic pigment is preferable when a light source having an exposure wavelength of from 380 nm to 500 nm is used, and, a metal phthalocyanine pigment or a metal-free phthalocyanine pigment is preferable when a case where a light source having an exposure wavelength of from 700 nm to 800 nm is used.

In the exemplary embodiment, as the charge generating material, at least one selected from a hydroxygallium phthalocyanine pigment and a chlorogallium phthalocyanine pigment is preferably used.

As the charge generating material, these pigments may be used alone or in combination thereof, as desired. Further, as the charge generating material, a hydroxygallium phthalocyanine pigment is preferable from the viewpoints of a high sensitivity of a photoreceptor and prevention of dot defects of an image.

The hydroxygallium phthalocyanine pigment is not particularly limited, but a V-type hydroxygallium phthalocyanine pigment is preferable.

Particularly, as the hydroxygallium phthalocyanine pigment, for example, a hydroxygallium phthalocyanine pigment having a maximum peak wavelength in the range of from 810 nm to 839 nm in a spectral absorption spectrum in a wavelength region of from 600 nm to 900 nm is preferable from the viewpoint that it imparts more excellent dispersibility. When the hydroxygallium phthalocyanine pigment is used as a material for an electrophotographic photoreceptor, characteristics of excellent dispersibility, sufficient sensitivity, chargeability, and dark attenuation are easily obtained.

Further, the hydroxygallium phthalocyanine pigment having a maximum peak wavelength in the range from 810 nm to 839 nm preferably has an average particle diameter in a specific range and a BET specific surface area in a specific range. Specifically, the average particle diameter is preferably 0.20 μm or less, and more preferably from 0.01 μm to 0.15 μm. On the other hand, the BET specific surface area is preferably 45 $m^2/g$ or more, more preferably 50 $m^2/g$ or more, and particularly preferably from 55 $m^2/g$ to 120 $m^2/g$. An average particle diameter is a volume average particle diameter (d50 average particle diameter) and a value measured by a laser diffraction scattering particle size distribution analyzer LA-700 (manufactured by Horiba Ltd.). Further, the BET specific surface area is a value measured by a nitrogen substitution method using a BET specific surface area analyzer (FLOWSORB II2300, manufactured by Shimadzu Corporation).

Here, in the case where the average particle diameter is more than 0.20 μm or the specific surface area value is less than 45 $m^2/g$, the pigment particles are coarsened or aggregates of pigment particles are formed in some cases. Further, the characteristics such as dispersibility, sensitivity, chargeability, and dark attenuation characteristics tend to be deteriorated, resulting in image defect in some cases.

A maximum particle diameter (a maximum value of a primary particle diameter) of the hydroxygallium phthalocyanine pigment is preferably 1.2 μm or less, more preferably 1.0 μm or less, and still more preferably 0.3 μm or less. When the maximum particle diameter exceeds the above range, black spots tend to be formed.

From the viewpoint of preventing the density unevenness caused by exposing a photoreceptor to a fluorescent lamp or the like from occurring, the hydroxygallium phthalocyanine pigment preferably has an average particle diameter of 0.2 μm or less, the maximum particle diameter of 1.2 μm or less and the specific surface area of 45 $m^2/g$ or more.

The hydroxygallium phthalocyanine pigment is preferably a V type one which has diffraction peaks at a Bragg angle (2θ±0.2°) of at least 7.3°, 16.0°, 24.9°, and 28.0° in an X-ray diffraction spectrum obtained using CuKα characteristic X-ray.

On the other hand, the chlorogallium phthalocyanine pigment is not particularly limited, but preferably has diffraction peaks at a Bragg angle (2θ±0.20) of 7.4°, 16.6°, 25.5°, and 28.3° in an X-ray diffraction spectrum obtained using CuKα characteristic X-ray, whereby excellent sensitivity for an electrophotographic photoreceptor material is obtained.

Suitable maximum peak wavelength of the spectral absorption spectrum, the average particle diameter, the maximum particle diameter, and the specific surface area value of the chlorogallium phthalocyanine pigment are the same as those of the hydroxygallium phthalocyanine pigment.

The content of the charge generating material based on the total solid content of the photosensitive layer is preferably from 1% by weight to 5% by weight, and more preferably from 1.2% by weight to 4.5% by weight.

—Hole Transport Material—

Examples of the hole transport material include triarylamine compounds, benzidine compounds, arylalkane compounds, aryl-substituted ethylene compounds, stilbene compounds, anthracene compounds, and hydrazone compounds. These hole transport materials may be used alone or as a mixture of two or more kinds thereof, but are not limited thereto.

The hole transport material is preferably a compound represented by the following formula (B-1), a compound represented by the following formula (B-2), and a compound represented by the following formula (B-3) from the viewpoint of charge mobility.

(B-1)

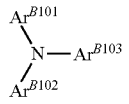

In the formula (B-1), each of $Ar^{B101}$, $Ar^{B102}$, and $Ar^{B103}$ independently represents a substituted or unsubstituted aryl group, $—C_6H_4—C(R^{B104})=C(R^{B105})(R^{B106})$, or $—C_6H_4—CH=CH—CH=C(R^{B107})(R^{B108})$. Each of $R^{B104}$, $R^{B105}$, $R^{B106}$, $R^{B107}$, and $R^{B108}$ independently represents a hydrogen atom, a substituted or unsubstituted alkyl group, or a substituted or unsubstituted aryl group.

Examples of the substituents in the respective groups include a halogen atom, an alkyl group having 1 to 5 carbon atoms, and an alkoxy group having 1 to 5 carbon atoms. In addition, examples of the substituents in the respective groups also include a substituted amino group substituted with an alkyl group having 1 to 3 carbon atoms.

(B-2)

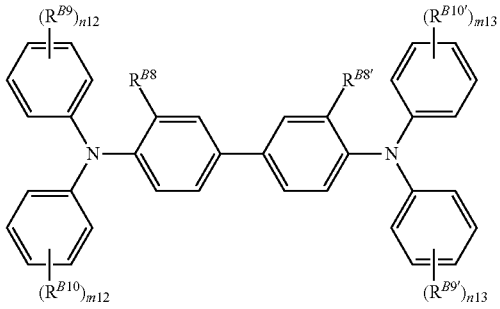

In the formula (B-2), $R^{B8}$ and $R^{B8'}$ may be the same as or different from each other and each independently represents a hydrogen atom, a halogen atom, an alkyl group having 1 to 5 carbon atoms, or an alkoxy group having 1 to 5 carbon atoms. $R^{B9}$, $R^{B9'}$, $R^{B10}$, and $R^{B10'}$ may be the same as or different from each other and each independently represents a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, —C($R^{B11}$)═C($R^{B12}$)($R^{B13}$), or —CH═CH—CH═C($R^{B14}$)($R^{B15}$) and $R^{B11}$ to $R^{B15}$ each independently represents a hydrogen atom, a substituted or unsubstituted alkyl group, or a substituted or unsubstituted aryl group. m12, m13, n12, and n13 each independently represents an integer of 0 to 2.

(B-3)

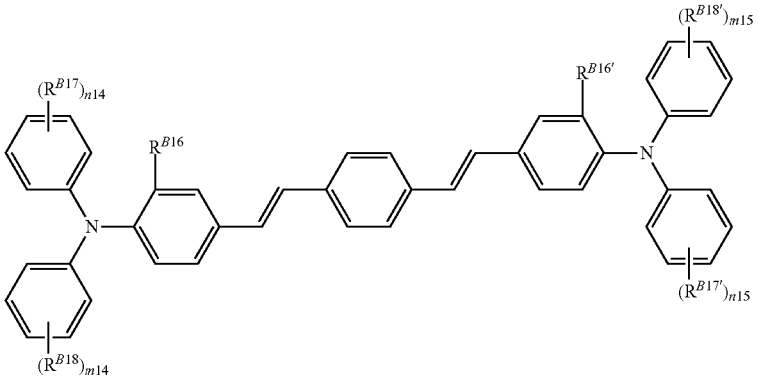

In the formula (B-3), $R^{B16}$ and $R^{B16'}$ may be the same as or different from each other and each independently represents a hydrogen atom, a halogen atom, an alkyl group having 1 to 5 carbon atoms, or an alkoxy group having 1 to 5 carbon atoms. $R^{B17}$, $R^{B17'}$, $R^{B18}$, and $R^{B18'}$ may be the same as or different from each other and each independently represents a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, —C($R^{B19}$)═C($R^{B20}$)($R^{B21}$), or —CH═CH—CH═C($R^{B22}$)($R^{B23}$), and $R^{B19}$ to $R^{B23}$ each independently represents a hydrogen atom, a substituted or unsubstituted alkyl group, or a substituted or unsubstituted aryl group. m14, m15, n14, and n15 each independently represents an integer of 0 to 2.

Here, among the compound represented by the formula (B-1), the compound represented by the formula (B-2), and the compound represented by the formula (B-3), the compound represented by the formula (B-1) having "—$C_6H_4$—CH═CH—CH═C($R^{B6}$)($R^{B7}$)" and the compound represented by the formula (B-2) having "—CH═CH—CH═C($R^{B14}$)($R^{B15}$)" are particularly preferable.

Specific examples of the compound represented by the formula (B-1), the compound represented by the formula (B-2), and the compound represented by the formula (B-3) include the following compounds.

HT-1

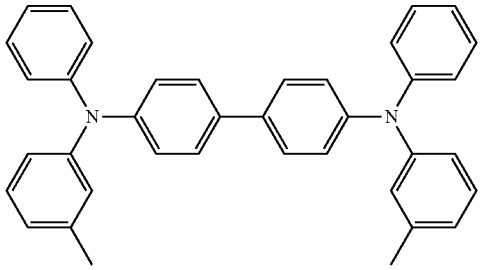

HT-2

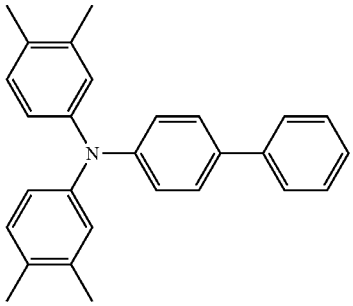

-continued
HT-3
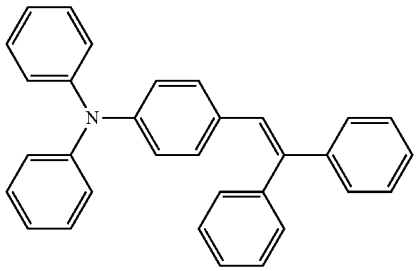
HT-4
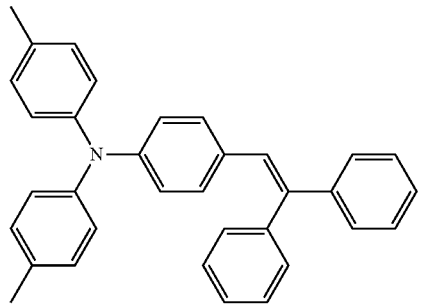
HT-5
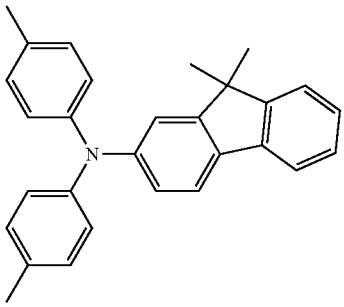
HT-6
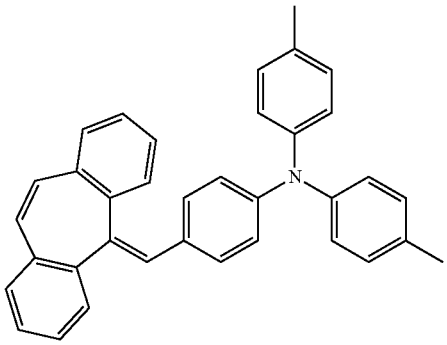
HT-7
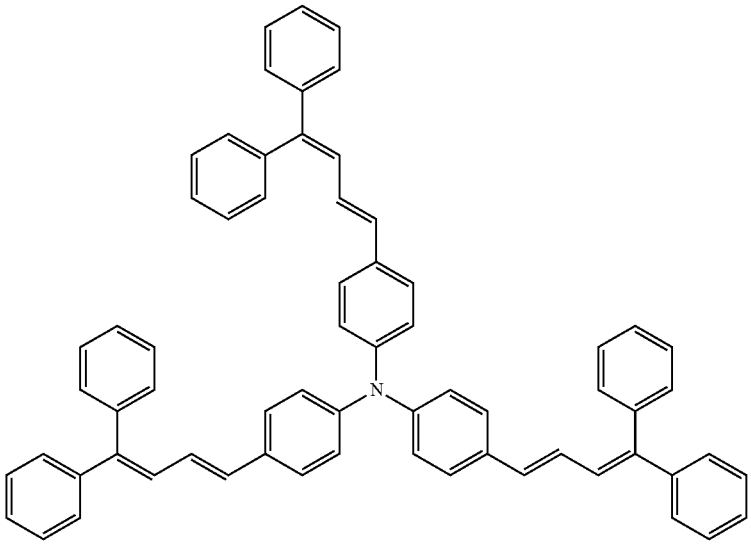
HT-8
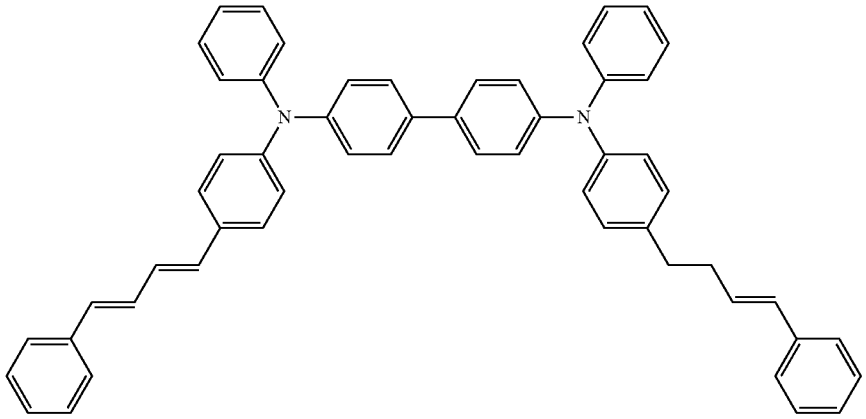

-continued

HT-9

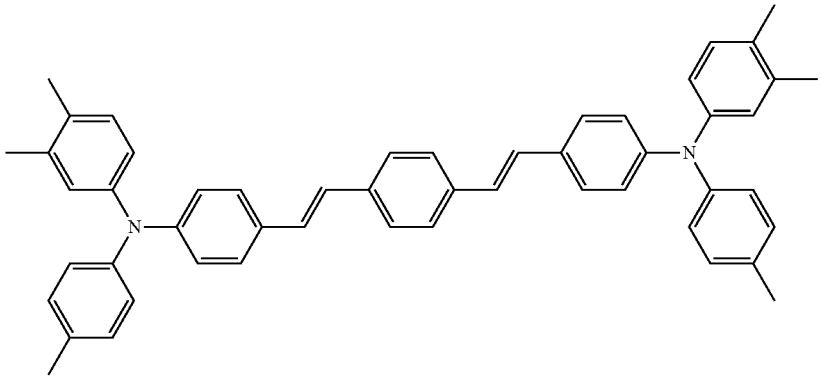

HT-10

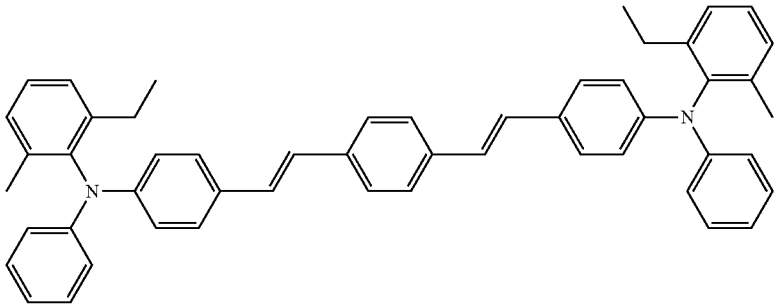

HT-11

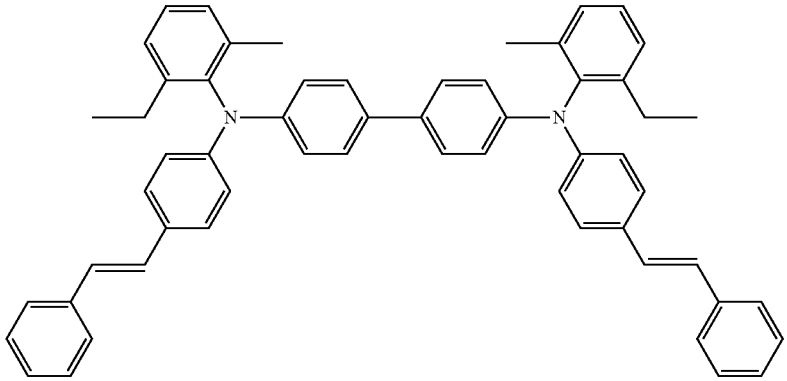

HT-12

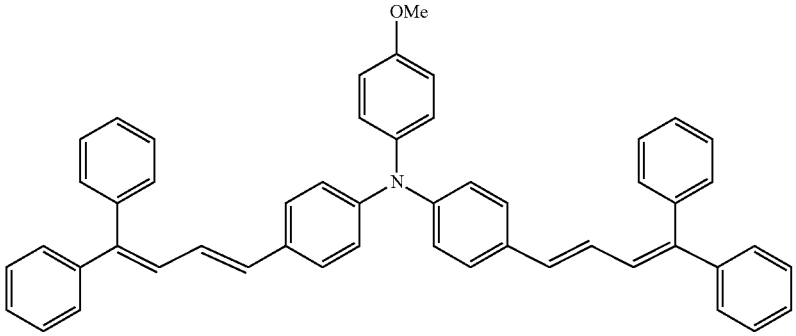

The content of the hole transport material based on the total solid content of the photosensitive layer is preferably from 10% by weight to 40% by weight, and more preferably from 20% by weight to 35% by weight. Further, the content of the hole transport material is the content of the entire hole transport material in the case of using a combination of plural kinds of hole transport materials.

—Electron Transport Material—

In the single layer type photosensitive layer of the present exemplary embodiment, as the electron transport material, as described above, both the first electron transport material represented by the formula (1) and the second electron transport material represented by the formula (2) are jointly used. Furthermore, as long as the functions are not impaired, other electron transport materials may be jointly used, as desired.

(1)

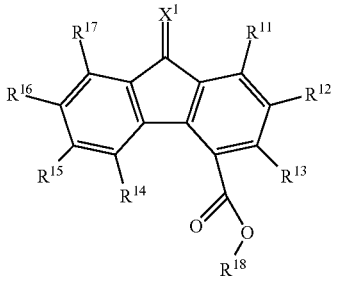

In the formula (1), $X^1$ represents an oxygen atom or $=C(CN)_2$. Each of $R^{11}$, $R^{12}$, $R^{13}$, $R^{14}$, $R^{15}$, $R^{16}$, and $R^{17}$ independently represents a hydrogen atom, a halogen atom, an alkyl group, an alkoxy group, an aryl group, or an aralkyl group. $R^{18}$ represents an alkyl group, $-L^{111}-O-R^{112}$, an aryl group, or an aralkyl group. In the formula, $L^{111}$ represents an alkylene group and $R^{112}$ represents an alkyl group.

Examples of the halogen atom represented by $R^{11}$, $R^{12}$, $R^{13}$, $R^{14}$, $R^{15}$, $R^{16}$, or $R^{17}$ in the formula (1) include a fluorine atom, a chlorine atom, a bromine atom, an iodine atom, and the like. Among these, a fluorine atom or a chlorine atom is preferable and a chlorine atom is more preferable.

Examples of the alkyl group represented by $R^{11}$, $R^{12}$, $R^{13}$, $R^{14}$, $R^{15}$, $R^{16}$, or $R^{17}$ in the formula (1) include linear or branched alkyl groups having 1 to 20 carbon atoms. Examples of the linear alkyl group include a methyl group, an ethyl group, a n-propyl group, a n-butyl group, a n-pentyl group, a n-hexyl group, a n-heptyl group, a n-octyl group, a n-nonyl group, a n-decyl group, and the like.

Examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, and the like. Among these, the number of carbon atoms in the alkyl group is more preferably in a range of 1 to 4 and still more preferably in a range of 1 to 3.

Examples of the alkoxy group represented by $R^{11}$, $R^{12}$, $R^{13}$, $R^{14}$, $R^{15}$, $R^{16}$, or $R^{17}$ in the formula (1) include alkoxy groups having 1 to 4 carbon atoms (preferably 1 to 3 carbon atoms). Specific examples thereof include a methoxy group, an ethoxy group, a propoxy group, a butoxy group, and the like.

The aryl group represented by $R^{11}$, $R^{12}$, $R^{13}$, $R^{14}$, $R^{15}$, $R^{16}$ or $R^{17}$ in the formula (1) may or may not have a substituent and examples thereof include a substituted or un substituted phenyl group. Examples of the substituent in the aryl group include an alkyl group having 1 to 10 carbon atoms, an alkoxy group, a halogen atom, and the like. Specific examples of the aryl group include a phenyl group, a methylphenyl group (tolyl group), a dimethylphenyl group, an ethylphenyl group, and the like.

Examples of the aralkyl group represented by $R^{11}$, $R^{12}$, $R^{13}$, $R^{14}$, $R^{15}$, $R^{16}$, or $R^{17}$ in the formula (1) include groups represented by $-R^{113}-Ar^{114}$. In this case, $R^{113}$ represents an alkylene group and $Ar^{114}$ represents an aryl group.

Examples of the alkylene group represented by $R^{113}$ include linear or branched alkylene groups having 1 to 12 carbon atoms and specific examples thereof include a methylene group, an ethylene group, an n-propylene group, an isopropylene group, an n-butylene group, an isobutylene group, a sec-butylene group, a tert-butylene group, an n-pentylene group, an isopentylene group, a neopentylene group, a tert-pentylene group, and the like. The number of carbon atoms in the alkylene group represented by $R^{113}$ is preferably in a range of 1 to 10 and more preferably in a range of 1 to 6 from the viewpoint of compatibility or solubility.

Examples of the aryl group represented by $Ar^{114}$ include the same groups as the aryl group represented by $R^{11}$, $R^{12}$, $R^{13}$, $R^{14}$, $R^{15}$, $R^{16}$, or $R^{17}$ in the formula (1) and the substituent in the aryl group is also the same as the substituent in the aryl group represented by $R^{11}$, $R^{12}$, $R^{13}$, $R^{14}$, $R^{15}$, $R^{16}$, or $R^{17}$.

Specific examples of the aralkyl group represented by $R^{11}$, $R^{12}$, $R^{13}$, $R^{14}$, $R^{15}$, $R^{16}$, or $R^{17}$ in the formula (1) include a benzyl group, a methyl benzyl group, a dimethyl benzyl group, a phenyl ethyl group, a methyl phenyl ethyl group, a phenyl propyl group, a phenyl butyl group, and the like.

Examples of the alkyl group represented by $R^{18}$ in the formula (1) include linear alkyl groups having 1 to 10 carbon atoms, branched alkyl groups having 3 to 10 carbon atoms, cyclic alkyl groups having 3 to 8 carbon atoms.

Examples of the linear alkyl group include a methyl group, an ethyl group, a n-propyl group, a n-butyl group, a n-pentyl group, a n-hexyl group, a n-heptyl group, a n-octyl group, a n-nonyl group, a n-decyl group, and the like.

Examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, and the like.

Examples of the cyclic alkyl group include a cyclopropyl group, a cyclobutyl group, a cyclopentyl group, a cyclohexyl group, a cycloheptyl group, a cyclooctyl group, and the like.

In the group represented by $-L^{111}-O-R^{112}$ represented by $R^{18}$ in the formula (1), $-L^{111}$ represents an alkylene group and $R^{112}$ represents an alkyl group.

Examples of the alkylene group represented by $L^{111}$ include linear or branched alkylene groups having 1 to 12 carbon atoms and examples thereof include a methylene group, an ethylene group, a n-propylene group, an isopropylene group, a n-butylene group, an isobutylene group, a sec-butylene group, a tert-butylene group, a n-pentylene group, an isopentylene group, a neopentylene group, a tert-pentylene group, and the like.

Examples of the alkyl group represented by $R^{112}$ include the same groups as the alkyl group represented by $R^{11}$, $R^{12}$, $R^{13}$, $R^{14}$, $R^{15}$, $R^{16}$, or $R^{17}$.

The aryl group represented by $R^{18}$ in the formula (1) may or may not have a substituent and examples thereof include substituted or unsubstituted phenyl groups. Examples of the substituent in the aryl group include alkyl groups having 1 to 10 carbon atoms, an alkoxy group, a halogen atom, and the like.

Furthermore, the aryl group is preferably further substituted with an alkyl group or an alkoxy group from the viewpoint of solubility. Examples of the alkyl group or the alkoxy group substituting the aryl group include the same groups as the alkyl group or the alkoxy group represented by $R^{11}$, $R^{12}$, $R^{3}$, $R^{14}$, $R^{15}$, $R^{16}$, or $R^{17}$. Examples of the aryl group substituted with the alkyl group or the alkoxy group include a methylphenyl group (tolyl group), a dimethylphenyl group, an ethylphenyl group, a tert-butylphenyl group (p-tert-butylphenyl or the like), a methoxyphenyl group (a p-methoxyphenyl group or the like), an ethoxyphenyl group, and the like.

Examples of the aralkyl group represented by $R^{18}$ in the formula (1) include groups represented by —$R^{115}$—$Ar^{116}$. In this case, $R^{115}$ represents an alkylene group and $Ar^{116}$ represents an aryl group.

Examples of the alkylene group represented by $R^{115}$ include linear or branched alkylene groups having 1 to 12 carbon atoms and examples thereof include a methylene group, an ethylene group, a n-propylene group, an isopropylene group, a n-butylene group, an isobutylene group, a sec-butylene group, a tert-butylene group, a n-pentylene group, an isopentylene group, a neopentylene group, a tert-pentylene group, and the like.

Examples of the aryl group represented by $Ar^{116}$ include a phenyl group, a methyl phenyl group, a dimethyl phenyl group, an ethyl phenyl group, and the like.

Specific examples of the aralkyl group represented by $R^{18}$ in the formula (1) include a benzyl group, a methyl benzyl group, a dimethyl benzyl group, a phenyl ethyl group, a methyl phenyl ethyl group, a phenyl propyl group, a phenyl butyl group, and the like.

Hereinafter, exemplary compounds of the electron transport material represented by the formula (1) will be shown, but not limited thereto. Furthermore, the exemplary compound numbers below will be indicated like an exemplary compound (1-number) below. Specifically, for example, the exemplary compound number will be indicated like "exemplary compound (1-15)".

| Formula (1) | $X^1$ | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|---|
| (1-1) | $=C(CN)_2$ | H | H | H | H | H | H | H | —n-Bu |
| (1-2) | $=C(CN)_2$ | H | H | H | H | H | H | H | —n-Oct |
| (1-3) | $=C(CN)_2$ | H | H | H | H | H | H | H | 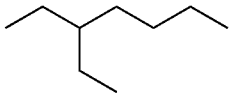 |
| (1-4) | $=C(CN)_2$ | H | H | H | H | H | H | H | 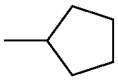 |
| (1-5) | $=C(CN)_2$ | H | H | H | H | H | H | H | 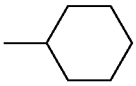 |
| (1-6) | $=C(CN)_2$ | H | H | H | H | H | H | H | 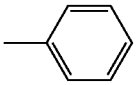 |
| (1-7) | $=C(CN)_2$ | H | H | H | H | H | H | H | 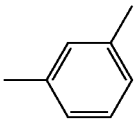 |
| (1-8) | $=C(CN)_2$ | H | H | H | H | H | H | H | 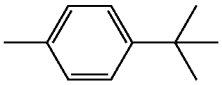 |
| (1-9) | $=C(CN)_2$ | H | H | H | H | H | H | H | 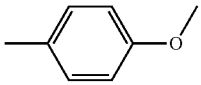 |
| (1-10) | $=C(CN)_2$ | H | H | H | H | H | H | H | 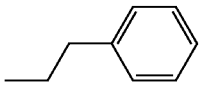 |
| (1-11) | $=C(CN)_2$ | H | —t-Bu | H | H | H | —t-Bu | H | —n-Bu |
| (1-12) | $=C(CN)_2$ | H | —t-Bu | H | H | H | —t-Bu | H | 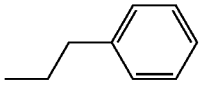 |
| (1-13) | $=C(CN)_2$ | H | Cl | H | H | H | Cl | H | —n-Oct |
| (1-14) | =O | H | H | H | H | H | H | H | —n-Bu |
| (1-15) | =O | H | H | H | H | H | H | H | —n-Oct |

-continued

| Formula (1) | $X^1$ | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|---|
| (1-16) | =O | H | H | H | H | H | H | H | |
| (1-17) | =O | H | H | H | H | H | H | H | |
| (1-18) | =O | H | H | H | H | H | H | H | |
| (1-19) | =O | H | H | H | H | H | H | H | |
| (1-20) | =O | H | H | H | H | H | H | H | |
| (1-21) | =O | H | H | H | H | H | H | H | |
| (1-22) | =O | H | H | H | H | H | H | H | |
| (1-23) | =O | H | H | H | H | H | H | H | |
| (1-24) | =O | H | t-Bu | H | H | H | t-Bu | H | —n-Bu |
| (1-25) | =O | H | t-Bu | H | H | H | t-Bu | H | |
| (1-26) | $=C(CN)_2$ | H | H | H | H | H | H | H | —n-$C_7H_{15}$ |
| (1-27) | $=C(CN)_2$ | H | H | H | H | H | H | H | —n-$C_5H_{11}$ |
| (1-28) | $=C(CN)_2$ | H | H | H | H | H | H | H | —n-$C_{10}H_{21}$ |
| (1-29) | $=C(CN)_2$ | Cl | Cl | Cl | Cl | Cl | Cl | Cl | —n-$C_7H_{15}$ |
| (1-30) | $=C(CN)_2$ | Cl | Cl | Cl | Cl | Cl | Cl | Cl | —n-$C_7H_{15}$ |
| (1-31) | $=C(CN)_2$ | Me | Me | Me | Me | Me | Me | Me | —n-$C_7H_{15}$ |
| (1-32) | $=C(CN)_2$ | Bu | Bu | Bu | Bu | Bu | Bu | Bu | —n-$C_7H_{15}$ |
| (1-33) | $=C(CN)_2$ | MeO | H | MeO | H | MeO | H | MeO | —n-$C_8H_{17}$ |
| (1-34) | $=C(CN)_2$ | Ph | Ph | Ph | Ph | Ph | Ph | Ph | —n-$C_8H_{17}$ |
| (1-35) | $=C(CN)_2$ | H | H | H | H | H | H | H | —n-$C_{11}H_{25}$ |
| (1-36) | $=C(CN)_2$ | H | H | H | H | H | H | H | —n-$C_9H_{19}$ |
| (1-37) | $=C(CN)_2$ | H | H | H | H | H | H | H | —$CH_2$—$CH(C_2H_5)$—$C_4H_9$ |
| (1-38) | $=C(CN)_2$ | H | H | H | H | H | H | H | —$CH_2$—Ph |
| (1-39) | =O | H | H | H | H | H | H | H | —n-$C_7H_{15}$ |
| (1-40) | =O | H | H | H | H | H | H | H | —n-$C_5H_{11}$ |
| (1-41) | =O | H | H | H | H | H | H | H | —n-$C_{10}H_{21}$ |
| (1-42) | =O | Cl | Cl | Cl | Cl | Cl | Cl | Cl | —n-$C_7H_{15}$ |
| (1-43) | =O | Cl | Cl | H | Cl | H | Cl | H | —n-$C_7H_{15}$ |
| (1-44) | =O | Me | Me | Me | Me | Me | Me | Me | —n-$C_7H_{15}$ |
| (1-45) | =O | Bu | Bu | Bu | Bu | Bu | Bu | Bu | —n-$C_7H_{15}$ |
| (1-46) | =O | MeO | H | MeO | H | MeO | H | MeO | —n-$C_8H_{17}$ |
| (1-47) | =O | Ph | Ph | Ph | Ph | Ph | Ph | Ph | —n-$C_8H_{17}$ |
| (1-48) | =O | H | H | H | H | H | H | H | —n-$C_{11}H_{25}$ |
| (1-49) | =O | H | H | H | H | H | H | H | —n-$C_9H_{19}$ |
| (1-50) | =O | H | H | H | H | H | H | H | —$CH_2$—$CH(C_2H_5)$—$C_4H_9$ |
| (1-51) | =O | H | H | H | H | H | H | H | —$CH_2$—Ph |

Abbreviations in the exemplary compounds are as described below. "Bu" represents a butyl group, "t-Bu" represents a tert-butyl group, "Oct" represents an octyl group, "Cl" represents a chlorine atom, "Me" represents a methyl group, "MeO" represents a methoxy group, and "Ph" represents a phenyl group, respectively.

(2)

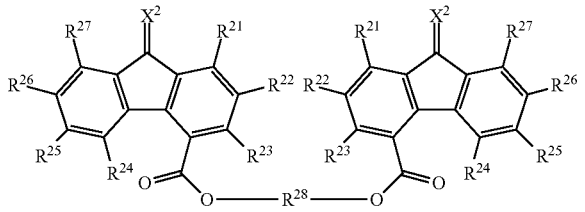

In the formula (2), $X^2$ represents an oxygen atom or $=C(CN)_2$. Each of $R^{21}$, $R^{22}$, $R^{23}$, $R^{24}$, $R^{25}$, $R^{26}$, and $R^{27}$ independently represents a hydrogen atom, a halogen atom, an alkyl group, an alkoxy group, an aryl group or an aralkyl group. $R^{28}$ represents an alkylene group having 4 to 20 carbon atoms or $-(L^{221}-O-L^{221})_n-$. In this case, $L^{221}$ each independently represents an alkylene group having 1 to 4 carbon atoms and n represents an integer of 1 to 10.

The halogen atom, the alkyl group, the alkoxy group, the aryl group or the aralkyl group represented by $R^{21}$, $R^{22}$, $R^{23}$, $R^{24}$, $R^{25}$, $R^{26}$, or $R^{27}$ in the formula (2) is the same as those of $R^{11}$, $R^{12}$, $R^{13}$, $R^{14}$, $R^{15}$, $R^{16}$, or $R^{17}$ in the formula (1).

Examples of the alkylene group having 4 to 20 carbon atoms represented by $R^{28}$ in the formula (2) include linear or branched alkylene groups. Examples thereof include a n-butylene group, an isobutylene group, a sec-butylene group, a tert-butylene group, a n-pentylene group, an isopentylene group, a neopentylene group, a tert-pentylene group, n-hexylene, n-heptylene, n-octylene, a n-nonylene group, a n-decylene group, an n-undecylene group, a n-dodecylene group, and the like. Additionally, examples thereof include a tridecylene group, a tetradecylene group, a pentadecylene group, a hexadecylene group, an octadecylene group, an eicosylene group, and the like. Among these, from the viewpoint of solubility in a resin, linear or branched alkylene groups having 6 to 12 carbon atoms are preferable.

In the group represented by $-(L^{221}-O-L^{221})_n-$ represented by $R^{28}$ in the formula (2), $L^{221}$ each independently represents a linear or branched alkylene group having 1 to 4 carbon atoms and n represents an integer of 1 to 10. Examples of $L^{221}$ include a methylene group, an ethylene group, a n-propylene group, an isopropylene group, a n-butylene group, an isobutylene group, a sec-butylene group, and a tert-butylene group. From the viewpoint of solubility in a resin, $L^{221}$ is preferably a methylene group and n is preferably an integer of 1 to 5.

Hereinafter, exemplary compounds of the electron transport material represented by the formula (1) will be shown, but not limited thereto. Furthermore, the exemplary compound numbers below will be indicated like an exemplary compound (2-number) below. Specifically, for example, the exemplary compound number will be indicated like "exemplary compound (2-15)".

| Formula (2) | $x^2$ | $R^{21}$ | $R^{22}$ | $R^{23}$ | $R^{24}$ | $R^{25}$ | $R^{26}$ | $R^{27}$ | $R^{28}$ |
|---|---|---|---|---|---|---|---|---|---|
| (2-1) | $=C(CN)_2$ | H | H | H | H | H | H | H | $-(CH_2)_6-$ |
| (2-2) | $=C(CN)_2$ | H | H | H | H | H | H | H | $-(CH_2)_7-$ |
| (2-3) | $=C(CN)_2$ | H | H | H | H | H | H | H | $-(CH_2)_8-$ |
| (2-4) | $=C(CN)_2$ | H | H | H | H | H | H | H | $-(CH_2)_9-$ |
| (2-5) | $=C(CN)_2$ | H | H | H | H | H | H | H | $-(CH_2)_{10}-$ |
| (2-6) | $=C(CN)_2$ | H | H | H | H | H | H | H | $-(CH_2)_{11}-$ |
| (2-7) | $=C(CN)_2$ | H | H | H | H | H | H | H | $-(CH_2)_{12}-$ |
| (2-8) | $=C(CN)_2$ | H | —t-Bu | H | H | H | —t-Bu | H | $-(CH_2)_8-$ |
| (2-9) | $=C(CN)_2$ | H | —t-Bu | H | H | H | —t-Bu | H | $-(CH_2)_{12}-$ |
| (2-10) | $=C(CN)_2$ | H | Cl | H | H | H | Cl | H | $-(CH_2)_8-$ |
| (2-11) | $=C(CN)_2$ | H | Cl | H | H | H | Cl | H | $-(CH_2)_{12}-$ |
| (2-12) | $=C(CN)_2$ | H | H | H | H | H | H | H | $-(CH_2OCH_2)_2-$ |
| (2-13) | $=C(CN)_2$ | H | H | H | H | H | H | H | $-(CH_2OCH_2)_5-$ |
| (2-14) | $=C(CN)_2$ | H | —t-Bu | H | H | H | —t-Bu | H | $-(CH_2OCH_2)_2-$ |
| (2-15) | $=C(CN)_2$ | H | —t-Bu | H | H | H | —t-Bu | H | $-(CH_2OCH_2)_5-$ |
| (2-16) | $=C(CN)_2$ | H | Cl | H | H | H | Cl | H | $-(CH_2OCH_2)_2-$ |
| (2-17) | $=O$ | H | H | H | H | H | H | H | $-(CH_2)_6-$ |
| (2-18) | $=O$ | H | H | H | H | H | H | H | $-(CH_2)_7-$ |
| (2-19) | $=O$ | H | H | H | H | H | H | H | $-(CH_2)_8-$ |
| (2-20) | $=O$ | H | H | H | H | H | H | H | $-(CH_2)_9-$ |
| (2-21) | $=O$ | H | H | H | H | H | H | H | $-(CH_2)_{10}-$ |
| (2-22) | $=O$ | H | H | H | H | H | H | H | $-(CH_2)_{11}-$ |
| (2-23) | $=O$ | H | H | H | H | H | H | H | $-(CH_2)_{12}-$ |
| (2-24) | $=O$ | H | —t-Bu | H | H | H | —t-Bu | H | $-(CH_2)_8-$ |
| (2-25) | $=O$ | H | —t-Bu | H | H | H | —t-Bu | H | $-(CH_2)_{12}-$ |
| (2-26) | $=O$ | H | Cl | H | H | H | Cl | H | $-(CH_2)_8-$ |
| (2-27) | $=O$ | H | Cl | H | H | H | Cl | H | $-(CH_2)_{12}-$ |
| (2-28) | $=O$ | H | H | H | H | H | H | H | $-(CH_2OCH_2)_2-$ |
| (2-29) | $=O$ | H | H | H | H | H | H | H | $-(CH_2OCH_2)_5-$ |
| (2-30) | $=O$ | H | —t-Bu | H | H | H | —t-Bu | H | $-(CH_2OCH_2)_2-$ |
| (2-31) | $=O$ | H | —t-Bu | H | H | H | —t-Bu | H | $-(CH_2OCH_2)_5-$ |
| (2-32) | $=O$ | H | Cl | H | H | H | Cl | H | $-(CH_2OCH_2)_2-$ |
| (2-33) | $=C(CN)_2$ | Cl | Cl | Cl | Cl | Cl | Cl | Cl | $-(CH_2)_7-$ |
| (2-34) | $=C(CN)_2$ | Cl | Cl | H | Cl | H | Cl | H | $-(CH_2)_7-$ |
| (2-35) | $=C(CN)_2$ | Me | Me | Me | Me | Me | Me | Me | $-(CH_2)_7-$ |
| (2-36) | $=C(CN)_2$ | Bu | Bu | Bu | Bu | Bu | Bu | Bu | $-(CH_2)_7-$ |
| (2-37) | $=C(CN)_2$ | MeO | H | MeO | H | MeO | H | MeO | $-(CH_2)_8-$ |
| (2-38) | $=C(CN)_2$ | Ph | Ph | Ph | Ph | Ph | Ph | Ph | $-(CH_2)_8-$ |
| (2-39) | $=O$ | Cl | Cl | Cl | Cl | Cl | Cl | Cl | $-(CH_2)_7-$ |

-continued

| Formula (2) | $x^2$ | $R^{21}$ | $R^{22}$ | $R^{23}$ | $R^{24}$ | $R^{25}$ | $R^{26}$ | $R^{27}$ | $R^{28}$ |
|---|---|---|---|---|---|---|---|---|---|
| (2-40) | =O | Cl | Cl | H | Cl | H | Cl | H | —$(CH_2)_7$— |
| (2-41) | =O | Me | Me | Me | Me | Me | Me | Me | —$(CH_2)_7$— |
| (2-42) | =O | Bu | Bu | Bu | Bu | Bu | Bu | Bu | —$(CH_2)_7$— |
| (2-43) | =O | MeO | H | MeO | H | MeO | H | MeO | —$(CH_2)_8$— |
| (2-44) | =O | Ph | Ph | Ph | Ph | Ph | Ph | Ph | —$(CH_2)_8$— |

Abbreviations in the exemplary compounds are as described below. "Bu" represents a butyl group, "t-Bu" represents a tert-butyl group, "Cl" represents a chlorine atom, "Me" represents a methyl group, "MeO" represents a methoxy group, and "Ph" represents a phenyl group, respectively.

$X^1$, $R^{11}$, $R^{12}$, $R^{13}$, $R^{14}$, $R^{15}$, $R^{16}$, and $R^{17}$ of the first electron transport material represented by the formula (1) and $X^2$, $R^{21}$, $R^{22}$, $R^{23}$, $R^{24}$, $R^{25}$, $R^{26}$, and $R^{27}$ of the second electron transport material represented by the formula (2) may be the same as or different from each other.

In the case where $X^1$, $R^{11}$, $R^{12}$, $R^{13}$, $R^{14}$, $R^{15}$, $R^{16}$, and $R^{17}$ of the first electron transport material represented by the formula (1) and $X^2$, $R^{21}$, $R^{22}$, $R^{23}$, $R^{24}$, $R^{25}$, $R^{26}$, and $R^{27}$ of the second electron transport material represented by the formula (2) may be the same as each other, the compatibility between the first electron transport material and the second electron transport material increases, the film-forming properties improve, and it becomes easy to prevent the precipitation of crystals.

In this case, $X^1$ of the first electron transport material is preferably $=C(CN)_2$ since the electron-transporting properties improve and $X^2$ of the second electron transport material is preferably an oxygen atom since the solubility in a resin is excellent. From the viewpoint of improving the electron-transporting ability and improving the solubility in a resin and the film-forming properties, it is more preferable to use a combination of an electron transport material in which $X^1$ of the first electron transport material is $=C(CN)_2$ and an electron transport material in which $X^2$ of the second electron transport material is an oxygen atom. In the case of this combination, it becomes easier to prevent a morphological change in the photosensitive layer.

In addition, functional groups which substitute $R^{11}$, $R^{12}$, $R^{13}$, $R^{14}$, $R^{15}$, $R^{16}$, and $R^{17}$ of the first electron transport material and $R^{21}$, $R^{22}$, $R^{23}$, $R^{24}$, $R^{25}$, $R^{26}$, and $R^{27}$ of the second electron transport material may be selected in consideration of the solubility in a resin, the precipitation of crystals, the electron-transporting ability, and the like. For example, when a halogen atom (a chlorine atom, a fluorine atom, or the like) is substituted, it becomes easy to improve the electron-transporting ability. In addition, for example, when an aryl group is substituted, it becomes easy to improve the electron-transporting ability and, furthermore, it becomes easy to improve the solubility in a resin having an aromatic ring such as a polycarbonate resin.

The amount of the first electron transport material represented by the formula (1) in the entire photosensitive layer is preferably in a range of 1% by weight to 25% by weight and more preferably in a range of 2% by weight to 10% by weight in terms of the ratio of the solid content in the photosensitive layer. In addition, the amount of the second electron transport material represented by the formula (2) is preferably in a range of 1% by weight to 25% by weight and more preferably in a range of 2% by weight to 10% by weight in terms of the ratio of the solid content in the photosensitive layer.

The amount of the total electron transport materials in the entire photosensitive layer is preferably in a range of 2% by weight to 30% by weight and more preferably in a range of 5% by weight to 20% by weight in terms of the ratio of the solid content in the photosensitive layer. When the content of the electron transport materials is within this range, favorable electrical characteristics may be obtained and it becomes easy to prevent the formation of fogging or black spots on a formed image.

Furthermore, in the case where other electron transport materials described below are used as the electron transport materials, the amount of other electron transport materials that are jointly used is preferably 30% by weight or less and more preferably 10% by weight or less with respect to all the electron transport materials.

The content ratio of the first electron transport material to the second electron transport material (the first electron transport material/the second electron transport material) in the photosensitive layer is preferably in a range of 1/10 to 10/1 in terms of the weight ratio. From the viewpoint of further improving the stability of the electrical characteristics or the film-forming properties, the content ratio thereof is more preferably in a range of 2/8 to 8/2 and still more preferably in a range of 3/7 to 7/3. Particularly, in the case where the content ratio is in a range of 3/7 to 7/3, a tendency that the electrical characteristics further improve appears.

Examples of other electron transport materials include electron-transporting compounds such as fluorenone derivatives, quinone compounds such as p-benzoquinone, chloranil, bromanil, and anthraquinone, tetracyanoquinodimethane compounds, fluorenone compounds such as 2,4,7-trinitrofluorenone, xanthone compounds, benzophenone compounds, cyanovinyl compounds, and ethylene compounds which are not the electron transport materials represented by the formula (1) and the formula (2). These other electron transport materials may be used singly or a mixture of two or more kinds of other electron transport materials may be used, but the electron transport material is not limited thereto.

Specific examples of other electron transport materials include the following compounds.

ET-A

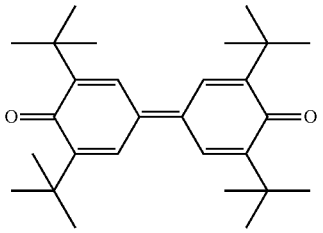

-continued

ET-B

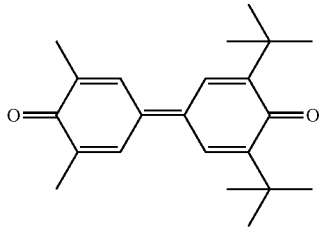

ET-C

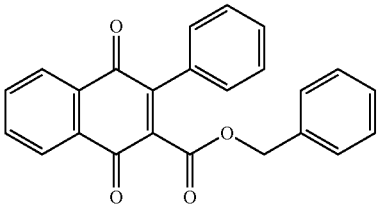

ET-E

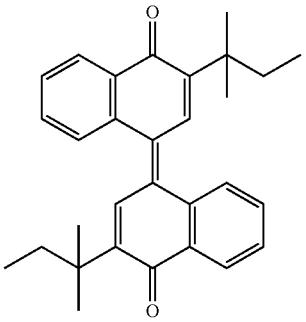

ET-F

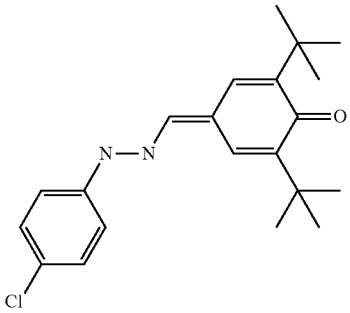

ET-G

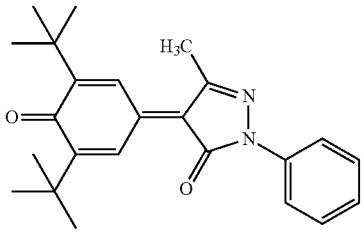

The ratio of the hole transport material to the electron transport material (the hole transport material/the electron transport material) is preferably in a range of 50/50 to 90/10 and more preferably in a range of 60/40 to 80/20 in terms of the weight ratio.

Furthermore, "the electron transport material" in the present ratio refers to the total amount of all the electron transport materials in the case where other electron transport materials are jointly used.

—Other Additives—

The single layer type photosensitive layer may include other known additives such as a surfactant, an antioxidant, a light stabilizer, and a heat stabilizer. Further, in the case where the single layer type photosensitive layer corresponds to a surface layer, it may include fluorine resin particles, silicone oils, or the like.

—Formation of Single Layer Type Photosensitive Layer—

The single layer type photosensitive layer is formed by using a coating liquid for forming a photosensitive layer obtained by adding the components above to a solvent.

Examples of the solvent include ordinary organic solvents, such as aromatic hydrocarbons such as benzene, toluene, xylene, and chlorobenzene; ketones such as acetone and 2-butanone; aliphatic hydrocarbon halides such as methylene chloride, chloroform, and ethylene chloride; and cyclic or linear ethers such as tetrahydrofuran and ethyl ether. These solvents may be used alone or in combination of two or more kinds thereof.

For a method for dispersing particles (for example, charge generating materials) in the coating liquid for forming a photosensitive layer, for example, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion to collide against liquid or against walls under a high pressure, and a penetration system in which the particles are dispersed by causing the dispersion to penetrate through a fine flow path under a high pressure.

Examples of a method for coating the coating liquid for forming a photosensitive layer onto the undercoat layer include a dipping coating method, an extrusion coating method, a wire bar coating method, a spray coating method, a blade coating method, a knife coating method, and a curtain coating method.

The film thickness of the single layer type photosensitive layer is set to a range of preferably from 5 μm to 60 μm, more preferably from 5 μm to 50 μm, and still more preferably from 10 μm to 40 μm.

[Image Forming Apparatus (and Process Cartridge)]

The image forming apparatus according to the present exemplary embodiment is provided with an electrophotographic photoreceptor, a charging unit that charges the surface of the electrophotographic photoreceptor, an electrostatic latent image forming unit that forms an electrostatic latent image on the surface of the charged electrophotographic photoreceptor, a developing unit that develops the electrostatic latent image formed on the surface of the electrophotographic photoreceptor by a developer including a toner to form a toner image, and a transfer unit that transfers the toner image onto a surface of a recording medium. Further, the electrophotographic photoreceptor according to the present exemplary embodiment is applied as the electrophotographic photoreceptor.

As the image forming apparatus according to the present exemplary embodiment, known image forming apparatuses provided with a device including a fixing unit that fixes a toner image transferred to the surface of a recording medium; a direct transfer type device that directly transfers the toner image formed on the surface of the electrophotographic photoreceptor to a recording medium; an intermediate transfer type device that primarily transfers the toner image formed on the surface of the electrophotographic photoreceptor to the surface of the intermediate transfer member, and secondarily transfers the toner image transferred to the surface of an intermediate transfer member to the surface of the recording medium; a device provided with a cleaning unit that cleans the surface of the electrophotographic photoreceptor after the transfer of the toner image and before charging; a device provided with an erasing unit that erases charges by irradiating the surface of an image holding member with erasing light, after the transfer of the toner image and before charging; a device provided with an electrophotographic photoreceptor heating member that increases the temperature of the electrophotographic photoreceptor to reduce the relative temperature; and the like are applied.

In the case of the intermediate transfer type device, for the transfer unit, for example, a configuration which includes an intermediate transfer member to the surface of which the toner image is transferred, a first transfer unit that primarily transfers a toner image formed on the surface of an image holding member to the surface of the intermediate transfer member, and a secondary transfer unit that secondarily transfers the toner image transferred to the surface of the intermediate transfer member to the surface of the recording medium is applied.

The image forming apparatus according to the present exemplary embodiment is any one of a dry development type image forming apparatus and a wet development type (development type using a liquid developer) image forming apparatus.

Furthermore, in the image forming apparatus according to the present exemplary embodiment, for example, a part provided with the electrophotographic photoreceptor may be a cartridge structure (process cartridge) that is detachable from an image forming apparatus. As the process cartridge, for example, a process cartridge including the electrophotographic photoreceptor according to the present exemplary embodiment is suitably used. Further, the process cartridge may include, in addition to the electrophotographic photoreceptor, for example, at least one selected from the group consisting of a charging unit, an electrostatic latent image forming unit, a developing unit, and a transfer unit.

Hereinafter, one example of the image forming apparatuses according to the present exemplary embodiment is shown, but the present invention is not limited thereto. Further, the main parts shown in the figures are described, and explanation of the others will be omitted.

Figure 2:
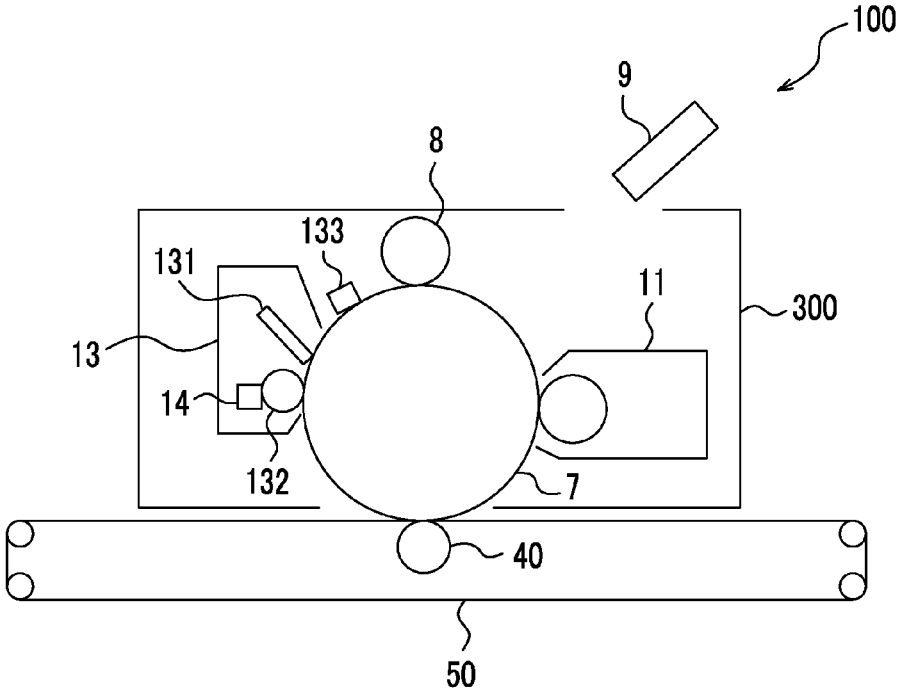
FIG. 2 is a configuration diagram schematically showing an image forming apparatus according to the present exemplary embodiment.

FIG. 2 is a configuration diagram schematically showing an example of the image forming apparatus according to the present exemplary embodiment.

The image forming apparatus 100 according to the present exemplary embodiment is provided with a process cartridge 300 provided with an electrophotographic photoreceptor 7 as shown in FIG. 2, an exposure device 9 (one example of the electrostatic latent image forming unit), a transfer device 40 (primary transfer device), and an intermediate transfer member 50. Further, in the image forming apparatus 100, the exposure device 9 is arranged at a position where the exposure device 9 may radiate light onto the electrophotographic photoreceptor 7 through an opening in the process cartridge 300, and the transfer device 40 is arranged at a position opposite to the electrophotographic photoreceptor 7 by the intermediary of the intermediate transfer member 50. The intermediate transfer member 50 is arranged to contact partially the electrophotographic photoreceptor 7. Further, although not shown in the figure, the apparatus also includes a secondary transfer device that transfers a toner image transferred onto the intermediate transfer member 50 to a recording medium (for example, paper). Further, the intermediate transfer member 50, the transfer device 40 (primary transfer device), and the secondary transfer device (not shown) correspond to an example of the transfer unit.

The process cartridge 300 in FIG. 2 supports, in a housing, the electrophotographic photoreceptor 7, a charging device 8 (one example of the charging unit), a developing device 11 (one example of the developing unit), and a cleaning device 13 (one example of the cleaning unit) integrally. The cleaning device 13 has a cleaning blade (one example of the cleaning member) 131, and the cleaning blade 131 is arranged so as to be in contact with the surface of the electrophotographic photoreceptor 7. Further, the cleaning member is not an aspect of the cleaning blade 131, may be a conductive or insulating fibrous member, and may be used alone or in combination with the cleaning blade 131.

Furthermore, FIG. 2 shows an example that includes fibrous member 132 (roll shape) that supplies a lubricant 14 to the surface of the electrophotographic photoreceptor 7, and a fibrous member 133 (flat brush shape) that assists in cleaning, as the image forming apparatus, but these members are disposed, as desired.

Hereinafter, the respective configurations of the image forming apparatus according to the present exemplary embodiment will be described.

—Charging Device—

As the charging device 8, for example, a contact type charging member using a conductive or semiconductive charging roll, a charging brush, a charging film, a charging rubber blade, a charging tube, or the like is used. Further, known charging devices, such as a non-contact type roller charging device, and a scorotron charging device and a corotron charging device, each using corona discharge, and the like are also used.

—Exposure Device—

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range from the spectral sensitivity wavelengths of the electrophotographic photoreceptor. As the wavelengths of semiconductor lasers, near infrared wavelengths having oscillation wavelengths near 780 nm are predominant. However, the wavelength of the laser ray to be used is not limited to such a wavelength, and a laser having an oscillation wavelength of 600 nm range, or a laser having any oscillation wavelength in the range from 400 nm to 450 nm may be used as a blue laser. In order to form a color image, it is also effective to use a surface-emitting type laser light source capable of attaining a multi-beam output.

—Developing Device—

As the developing device 11, for example, a common developing device, in which a developer is contacted or not contacted for developing an image, may be used. Such a developing device 11 is not particularly limited as long as it has the above-described functions, and may be appropriately selected according to the intended use. Examples thereof include a known developing device which functions to adhere the single-component or two-component developer to the electrophotographic photoreceptor 7 using a brush or a roller. Among these, the developing device using developing roller retaining developer on the surface thereof is preferable.

The developer used in the developing device 11 may be a single-component developer formed of a toner alone or a two-component developer formed of a toner and a carrier. Further, the developer may be magnetic or non-magnetic. As the developer, known ones may be applied.

—Cleaning Device—

As the cleaning device 13, a cleaning blade type device provided with the cleaning blade 131 is used.

Further, in addition to the cleaning blade type, a fur brush cleaning type and a type of performing developing and cleaning at once may also be employed.

—Transfer Device—

Examples of the transfer device 40 include known transfer charging devices, such as a contact type transfer charging device using a belt, a roller, a film, a rubber blade, or the like, a scorotron transfer charging device, and a corotron transfer charging device utilizing corona discharge.

—Intermediate Transfer Member—

As the intermediate transfer member 50, a belt-shaped member (intermediate transfer belt) including polyimide, polyamideimide, polycarbonate, polyarylate, polyester, rubber, or the like which is imparted with the semiconductivity is used. In addition, the intermediate transfer member may also take the form of a drum, in addition to the form of a belt.

Figure 3:
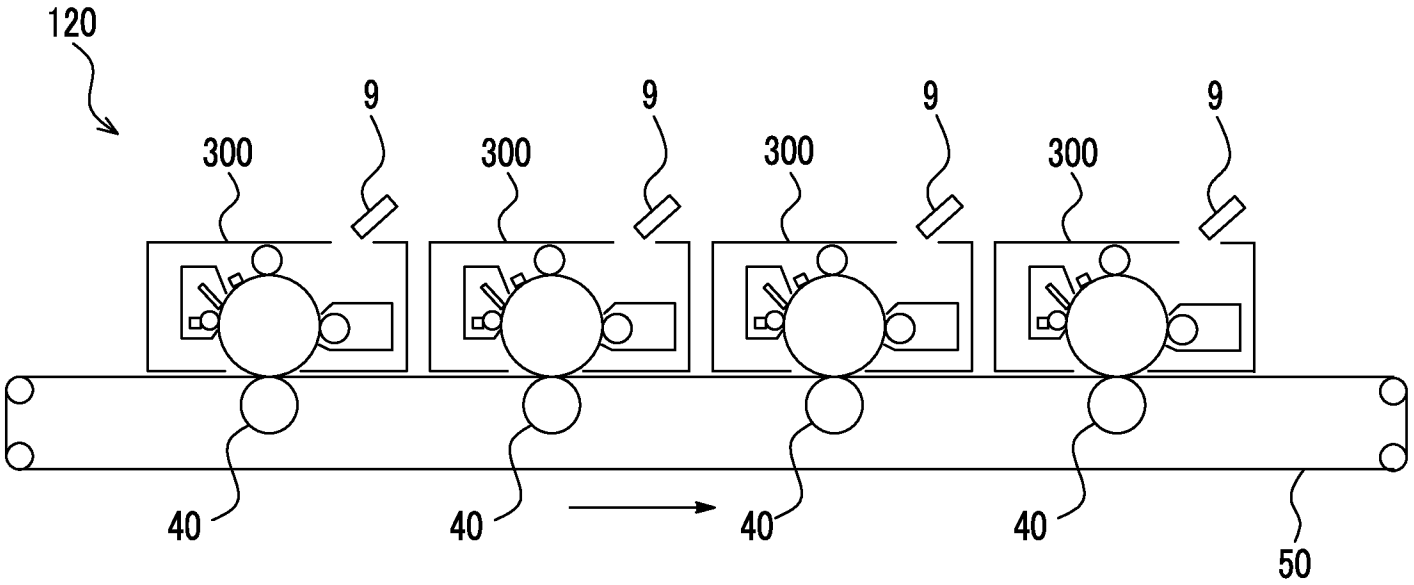
FIG. 3 is another configuration diagram schematically showing an image forming apparatus according to the present exemplary embodiment.

FIG. 3 is a configuration diagram schematically showing another example of the image forming apparatus according to the present exemplary embodiment.

The image forming apparatus 120 shown in FIG. 3 is a tandem type full color image forming apparatus equipped with four process cartridges 300. In the image forming apparatus 120, four process cartridges 300 are disposed parallel with each other on the intermediate transfer member 50, and one electrophotographic photoreceptor may be used for one color. Further, the image forming apparatus 120 has the same configuration as the image forming apparatus 100, except that it is a tandem type.

Further, the image forming apparatus 100 according to the present exemplary embodiment is not limited to the configuration. For example, it may be configured to provide a first erasing device for making the erasing with a cleaning brush easier by matching the polarity of the residual toner in the periphery of the electrophotographic photoreceptor 7, on the downstream side of the transfer device 40 in the rotating direction of the electrophotographic photoreceptor 7 and on the upstream side of the cleaning device 13 in the rotating direction of the electrophotographic photoreceptor, or to provide a second erasing device by erasing the charge of the surface of the electrophotographic photoreceptor 7 on the downstream side of the cleaning device 13 in the rotating direction of the electrophotographic photoreceptor and on the upstream side of the charging device 8 in the rotating direction of the electrophotographic photoreceptor.

Furthermore, the image forming apparatus 100 according to the present exemplary embodiment is not limited to the configurations above, and an image forming apparatus having a well-known configuration, for example, a direct transfer mode, in which a toner image formed in an electrophotographic photoreceptor 7 is directly transferred onto a recording medium, may be employed.

EXAMPLES

Hereinafter, the present exemplary embodiment will be described in detail using examples, but the present exemplary embodiment is by no means limited to these examples. Furthermore, in the following description, unless particularly otherwise described, "parts" and "%" are all weight basis.

Synthesis of Electron Transport Material

Synthesis Example 1

Synthesis of Dimer of Compound Having Fluorenone Skeleton (Exemplary Compound (2-23))

After 15 g of 9-fluorenone-4-carboxylic acid is dissolved in 50 ml of N,N-dimethylacetoamide, 9.25 g of potassium carbonate is added to the solution and the obtained mixture is stirred for 30 minutes. After that, 9.84 g of 1,12-dibromododecane is added and the obtained mixture is heated and stirred at 80° C. for three hours. The reaction solution is poured into 100 ml of water and precipitated crystals are filtered.

The crystals are dissolved in 200 ml of toluene, are washed with water, then, are dried using sodium sulfate, are made to pass through 40 g of silica gel, and then are recrystallized from toluene, thereby obtaining 17 g of a target compound (2-23).

Figure 4:
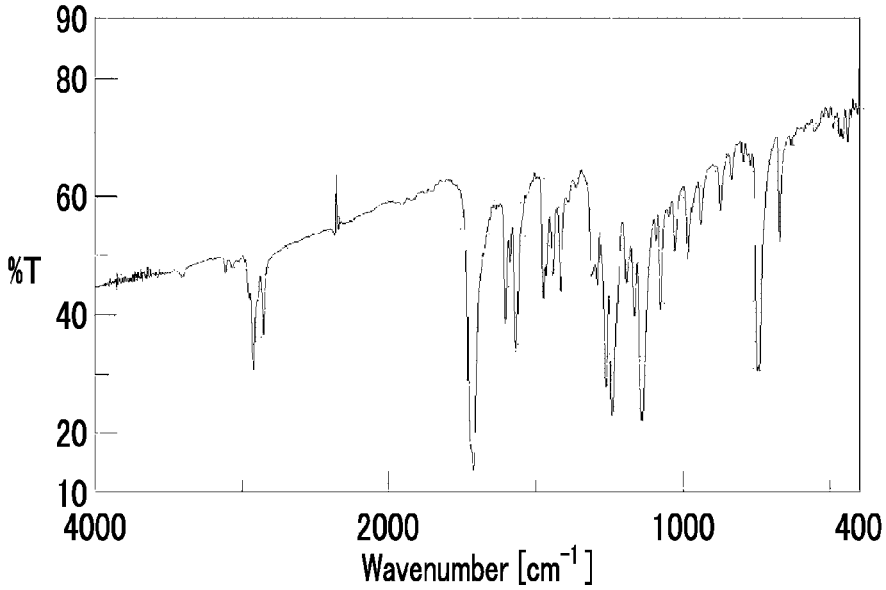
FIG. 4 is a graph showing an infrared absorption spectrum of Exemplary Compound (2-23) obtained in Synthesis Example 1.

As a result of measuring the melting point of the target compound (2-23), the melting point is in a range of 100° C. to 101° C. The infrared absorption spectrum is shown in FIG. 4.

(2-23)

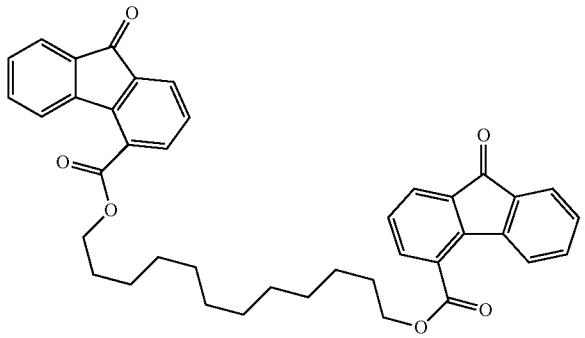

Synthesis Example 2

Synthesis of Dimer of Compound Having Fluorenone Skeleton (Exemplary Compound (2-7))

10 g of the dimer obtained in the synthesis example 1 is dissolved under heating in 100 ml of a liquid mixture of ethyl acetate/toluene (1/1), 4.3 g of malononitrile and 0.3 g of piperidine are added at room temperature, and then the obtained mixture are heated and stirred at 50° C. for one hour. Further, 100 ml of toluene is added, and an organic layer is washed with water and is dried using magnesium sulfate. After that, the mixture is treated by passing the mixture through 20 g of silica gel and crystals are recrystallized from a liquid mixture of toluene/ethyl acetate (3/1), thereby obtaining 9.9 g of a target compound (2-7).

Figure 5:
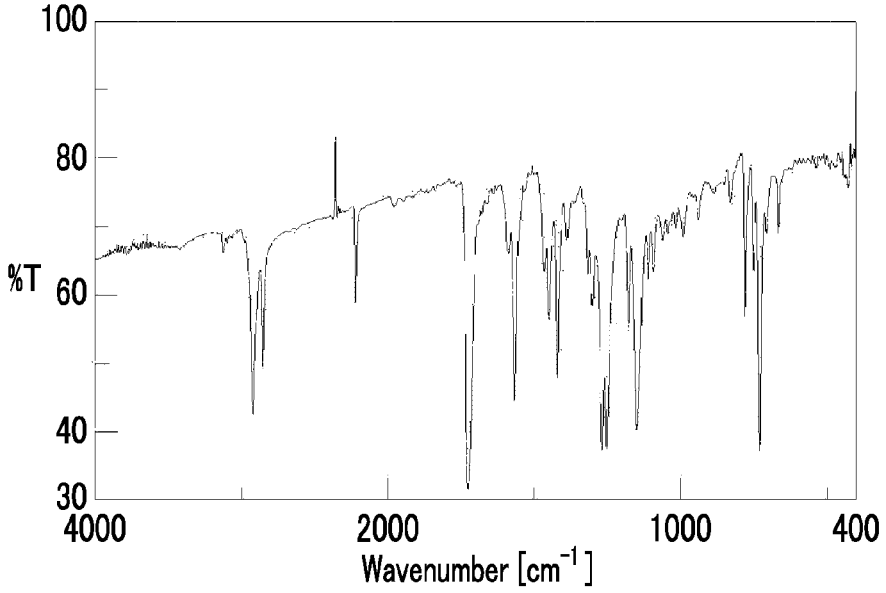
FIG. 5 is a graph showing an infrared absorption spectrum of Exemplary Compound (2-7) obtained in Synthesis Example 2.

As a result of measuring the melting point of the target compound (2-7), the melting point is in a range of 148° C. to 152° C. The infrared absorption spectrum is shown in FIG. 5.

(2-7)

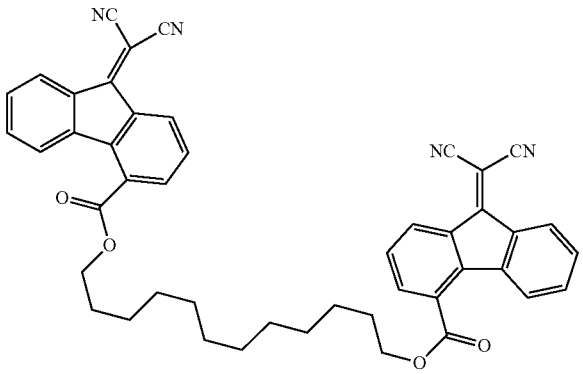

Synthesis Example 3

Synthesis of Dimer of Compound Having Fluorenone Skeleton (Exemplary Compound (2-19))

50 ml of a methylene chloride solution of 7.3 g of 9-fluorenone-4-carboxylic acid chloride is added dropwise to a liquid obtained by dissolving 2 g of 1,8-octanediol and 3.06 g of trimethylamine in 20 ml of methylene chloride for 15 minutes. After the mixture is stirred for one night as it is, precipitated crystals are filtered, the crystals are sequentially washed with water and acetone, and then the crystals are recrystallized from tetrahydrofuran, thereby obtaining 3.2 g of a target compound (2-19).

Figure 6:
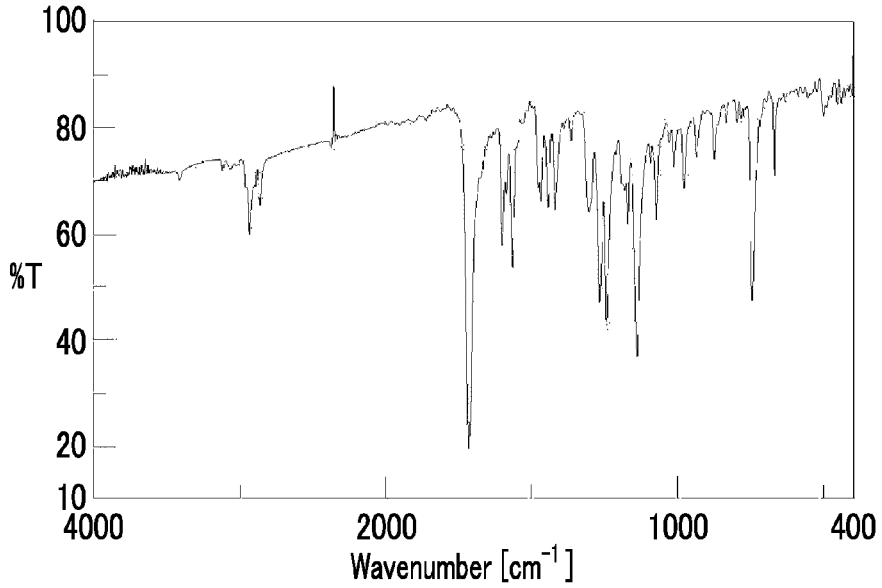
FIG. 6 is a graph showing an infrared absorption spectrum of Exemplary Compound (2-19) obtained in Synthesis Example 3.

As a result of measuring the melting point of the target compound (2-19), the melting point is in a range of 152° C. to 154° C. The infrared absorption spectrum is shown in FIG. 6.

(2-19)

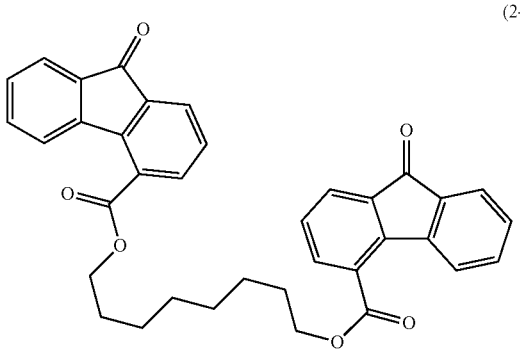

Example 1

A coating liquid for forming a photosensitive layer prepared in a procedure described below is applied to an aluminum substrate having a diameter of 30 mm, a length of 340 mm, and a thickness of 1 mm by a dipping coating method and is dried at 135° C. for one hour, thereby forming a photoreceptor 1 having a film thickness of 24 μm.

Examples 2 to 13 and Comparative Examples 1 and 2

Photoreceptors 2 to 13 and photoreceptors C1 and C2 are produced in the same manner as in Example 1 except that the presence or absence of the undercoat layer, the kinds of the hole transport materials used for the coating liquid for forming a photosensitive layer, and the kinds and contents of the first electron transport materials and the second electron transport materials are changed according to Table 1.

Furthermore, the undercoat layer is formed on the aluminum substrate in a procedure described below.

Preparation of Coating Liquid for Forming Photosensitive Layer

A mixture of 1.5 parts by weight of hydroxygallium phthalocyanine having diffraction peaks at the Bragg's angles (2θ±0.20) of at least 7.3°, 16.0°, 24.9°, and 28.0° in an X-ray diffraction spectrum, for which a CuKα characteristic X-ray is used, and 1.5 parts by weight of chlorogallium phthalocyanine having diffraction peaks at the Bragg's angles (2θ±0.20) of at least 7.4°, 16.6°, 25.5°, and 28.3° in an X-ray diffraction spectrum, for which a CuKα characteristic X-ray is used as a charge generating material, 49 parts by weight of a polycarbonate Z resin as the binder resin, and 300 parts by weight of tetrahydrofuran is dispersed for eight hours in a sand mill using glass beads having a diameter of 1 mmϕ.

32 parts by weight of a hole transport material (HT-4) having the following structure, 5 parts by weight of the exemplary compound (1-4) as the first electron transport material, 5 parts by weight of the exemplary compound (2-23) as the second electron transport material, and 0.001 parts by weight of silicone oil KP340 (manufactured by Shin-Etsu Chemical Co., Ltd.) are added to the obtained dispersion and the mixture is stirred for one night, thereby obtaining a coating liquid for forming a photosensitive layer.

(Formation of Undercoat Layer)

100 parts by weight of zinc oxide (average particle diameter: 70 nm, manufactured by TAYCA, specific surface area: 15 $m^2/g$) is stirred and mixed with 500 parts by weight of tetrahydrofuran, 1.2 parts by weight of a silane coupling agent (KBE502: manufactured by Shin-Etsu Chemical Co., Ltd.) is added thereto, followed by stirring for two hours. Subsequently, tetrahydrofuran is distilled away through distillation under reduced pressure and the components are baked at 120° C. for three hours, thereby obtaining zinc oxide surface-treated with a silane coupling agent.

110 parts by weight of the obtained zinc oxide surface-treated with a silane coupling agent is stirred and mixed with 500 parts by weight of tetrahydrofuran, and a solution formed by dissolving 0.7 parts by weight of alizarin in 50 parts by weight of tetrahydrofuran is added thereto, followed by stirring at 50° C. for 4 hours. Subsequently, zinc oxide to which alizarin is added is separated by filtration under a reduced pressure and dried under reduced pressure at 65° C. to obtain alizarin-attached zinc oxide.

38 parts by weight of a solution formed by dissolving 60 parts by weight of the alizarin-attached zinc oxide, 13.5 parts by weight of a curing agent (blocked isocyanate SUMIDUR 3175, manufactured by Sumitomo Bayer Urethane Co., Ltd.), and 15 parts by weight of a butyral resin (S-LEC BM-1, manufactured by Sekisui Chemical Co., Ltd.) in 85 parts by weight of methyl ethyl ketone and 50 parts by weight of methyl ethyl ketone are mixed together and dispersion is carried out for 2 hours 30 minutes in a sand mill using 1 mmϕ glass beads, thereby obtaining a dispersion.

0.005 parts by weight of dioctyltin dilaurate as a catalyst and 40 parts by weight of silicone resin particles (TOSPEARL 145, manufactured by Momentive Performance Materials Inc.) are added to the obtained dispersion, thereby obtaining a coating liquid for forming an undercoat layer.

The obtained coating liquid is applied to an aluminum substrate having a diameter of 30 mm, a length of 340 mm, and a thickness of 1 mm by a dipping coating method and is dried and cured at 170° C. for 40 minutes, thereby obtaining an undercoat layer having a thickness of 4 μm.

TABLE 1

| | | | | Electron transport material | | | | |
|---|---|---|---|---|---|---|---|---|
| | | | Hole | First ETM | | Second ETM | | Content ratio |
| | Photoreceptor No. | Undercoat layer | transport material | Exemplary compound | Content (parts) | Exemplary compound | Content (parts) | (weight ratio) First/second |
| Example 1 | Photoreceptor 1 | Absence | HT-4 | 1-4 | 5 | 2-23 | 5 | 1/1 |
| Example 2 | Photoreceptor 2 | Absence | HT-4 | 1-4 | 2 | 2-23 | 8 | 1/4 |
| Example 3 | Photoreceptor 3 | Absence | HT-4 | 1-4 | 8 | 2-23 | 2 | 4/1 |
| Example 4 | Photoreceptor 4 | Absence | HT-1 | 1-3 | 5 | 2-7 | 5 | 1/1 |
| Example 5 | Photoreceptor 5 | Absence | HT-1 | 1-2 | 8 | 2-7 | 2 | 4/1 |
| Example 6 | Photoreceptor 6 | Absence | HT-2 | 1-22 | 3 | 2-13 | 6 | 1/2 |
| Example 7 | Photoreceptor 7 | Absence | HT-2 | 1-11 | 10 | 2-7 | 2 | 5/1 |
| Example 8 | Photoreceptor 8 | Absence | HT-12 | 1-7 | 6 | 2-23 | 4 | 3/2 |
| Example 9 | Photoreceptor 9 | Absence | HT-4 | 1-2 | 10 | 2-19 | 2 | 5/1 |
| Example 10 | Photoreceptor 10 | Absence | HT-4 | 1-2 | 10 | 2-3 | 2 | 5/1 |
| Example 11 | Photoreceptor 11 | Presence | HT-4 | 1-4 | 5 | 2-23 | 5 | 1/1 |
| Example 12 | Photoreceptor 12 | Absence | HT-4 | 1-4 | 1 | 2-23 | 9 | 1/9 |
| Example 13 | Photoreceptor 13 | Absence | HT-4 | 1-4 | 9 | 2-23 | 1 | 9/1 |
| Comparative Example 1 | Photoreceptor C1 | Absence | HT-4 | 1-4 | 10 | — | 0 | — |
| Comparative Example 2 | Photoreceptor C2 | Absence | HT-4 | — | 0 | 2-23 | 10 | 0 |

Furthermore, the details of the abbreviations in Table 1 are as described below.

—Hole Transport Material—

HT-1: exemplary compound (HT-1) of the compound represented by the formula (B-2)

HT-2: exemplary compound (HT-2) of the compound represented by the formula (B-1)

HT-4: exemplary compound (HT-4) of the compound represented by the formula (B-1)

HT-12: exemplary compound (HT-12) of the compound represented by the formula (B-1)

—Electron Transport Material—

First ETM: first electron transport material represented by the formula (1)

Second ETM: second electron transport material represented by the formula (2)

2-7: exemplary compound (2-7) obtained in the synthesis Example 2

2-19: exemplary compound (2-19) obtained in the synthesis example 3

2-23: exemplary compound (2-23) obtained in the synthesis example 1

2-13: exemplary compound (2-13) of the electron transport material represented by the formula (2)

First/second: the content ratio between the first electron transport material and the second electron transport material (weight ratio)

(The First Electron Transport Material/the Second Electron Transport Material)

<Evaluation>

The following evaluations on each of the obtained electrophotographic photoreceptors are carried out, and the results are shown in Table 2.

—Evaluation of Film-forming Properties—

After the photoreceptor obtained in each example is stored under environments of an air temperature of 28° C. and a humidity of 85% RH for 48 hours, the surface state is visually observed. The results are shown in Table 2.

A: The appearance is favorable as a whole without any problem.

B: Unevenness caused by crystallization or the deteriorated compatibility is confirmed.

(An Acceptable Level in Terms of Image Qualities)

C: Clear defects caused by crystal precipitation is confirmed (An Unacceptable, Level in Terms of Image Qualities)

—Evaluation of Charging Durability—

An image forming apparatus (manufactured by Brother Industries, Ltd., HL-5440D) is remodeled so that an external power supply is attached thereto. This image forming apparatus is charged to an initial charge potential of 700 V under environments of a room temperature of 28° C. and a humidity of 85% and the drop of the charge potential after printing of 10,000 full-black solid images is evaluated. The results are shown in Table 2.

A: The potential drop is 40 V or less and there is no problem.

B: The potential drop is in a range of more than 40 V to less than 80 V, which is an adjustable range, and there is no problem.

C: The potential drop is 80 V or more, which is an unadjustable level.

—Evaluation of Black Spots—

The obtained electrophotographic photoreceptor is mounted in an image forming apparatus (manufactured by Brother Industries, Ltd., HL-2240D), 10,000 of 50% halftone images are printed under environments of a room temperature of 28° C. and a humidity of 85%, and the formation of black spots having a diameter of 0.3 μm or larger in the final $10,000^{th}$ image is evaluated using the following standards. The results are shown in Table 2.

A: Black spots are not formed.

B: Black spots are confirmed and there is no problem with image qualities (5 spots or less).

C: A number of black spots are formed and there is a practical problem (6 spots or more).

TABLE 2

| | Photoreceptor No. | Film-forming properties Evaluation | Charging durability (V) | Charging durability Evaluation | Evaluation of black spots |
|---|---|---|---|---|---|
| Example 1 | Photoreceptor 1 | A | 32 | A | A |
| Example 2 | Photoreceptor 2 | A | 38 | A | A |
| Example 3 | Photoreceptor 3 | A | 28 | A | A |
| Example 4 | Photoreceptor 4 | A | 30 | A | A |
| Example 5 | Photoreceptor 5 | A | 30 | A | A |
| Example 6 | Photoreceptor 6 | A | 31 | A | A |
| Example 7 | Photoreceptor 7 | A | 39 | A | A |
| Example 8 | Photoreceptor 8 | A | 32 | A | A |
| Example 9 | Photoreceptor 9 | A | 40 | A | A |
| Example 10 | Photoreceptor 10 | A | 38 | A | A |
| Example 11 | Photoreceptor 11 | A | 39 | A | A |
| Example 12 | Photoreceptor 12 | B | 48 | B | B |
| Example 13 | Photoreceptor 13 | B | 55 | B | B |
| Comparative Example 1 | Photoreceptor C1 | B | 85 | C | C |
| Comparative Example 2 | Photoreceptor C2 | C | 55 | B | C |

From the above-described results, it is found that, compared with the comparative examples, in the present examples, the film-forming properties and the charging durability are favorable. In addition, it is found that, in the present examples, the evaluation of black spots is favorable.

—Enthalpy Relaxation Amount—

The changes in the enthalpy relaxation amount are evaluated from the photosensitive layers in the obtained photoreceptor 1 of the example 1 and the photoreceptor C1 of the comparative example 1. The evaluation method is as described below.

Approximately 3 mg of a photosensitive layer in a photoreceptor that is produced in totally the same manner as the photoreceptor 1 of the example 1 is cut out and is used as a sample 1. Approximately 3 mg of the photosensitive layer in the photoreceptor 1 of the example 1 after the evaluation of black spots is cut out and is used as a sample 2.

Figure 7:
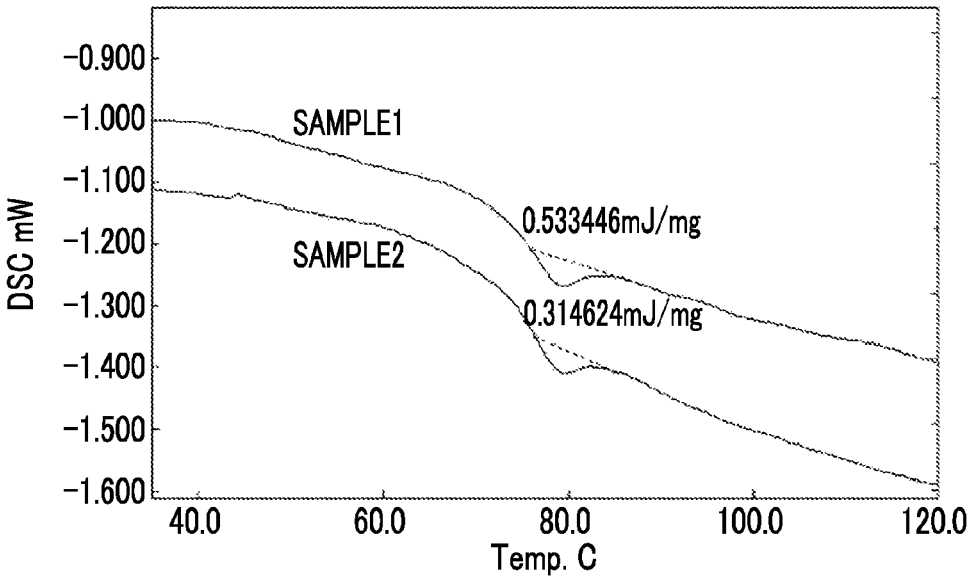
FIG. 7 is a graph showing differential scanning calorimetry indicating a change in the enthalpy relaxation amount of a photosensitive layer in a photoreceptor obtained in Example 1.

Next, the so-called enthalpy relaxation in which the temperature is increased by 10° C. every minute from room temperature and glass transition signals turn into endothermic peaks is measured using a differential scanning calorimeter DSC-6200 manufactured by Seiko instruments Inc. The enthalpy relaxation peak refers to the area of a portion surrounded by the solid line and the dotted line in the following drawing (FIG. 7). The difference of the enthalpy relaxation between the two samples is obtained.

FIG. 7 shows a graph of DSC of the change in the enthalpy relaxation amount before and after the evaluation of the photoreceptor 1 of the example 1 and the change in the enthalpy relaxation amount is obtained using the following equation.

The change in the enthalpy relaxation amount=(the enthalpy relaxation of the sample 2)−(the enthalpy relaxation of the sample 1)=0.533446−0.314624≈0.22 [mJ/mg].

The evaluation results of the photoreceptor 5 of the example 5 and the photoreceptor C2 of the comparative example 2 are shown in Table 3 in the same manner.

TABLE 3

| | Photoreceptor No. | Change amount of enthalpy relaxation amount |
|---|---|---|
| Example 1 | Photoreceptor 1 | 0.22 mJ/mg |
| Example 5 | Photoreceptor 5 | 0.40 mJ/mg |
| Comparative Example 1 | Photoreceptor C1 | 0.62 mJ/mg |
| Comparative Example 2 | Photoreceptor C2 | 0.51 mJ/mg |

From the above-described results, it is considered that, compared with the comparative examples 1 and 2, in the examples 1 and 5, the change amount of the enthalpy relaxation amount is small and the change of strains remaining in the film is small. Therefore, it is found that, in the examples, compared with the comparative examples, a morphological change does not easily occur in the photosensitive layer and the photoreceptors are more stable as films.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer that is a single layer type photosensitive layer provided on the conductive substrate, wherein the photosensitive layer includes a binder resin, a charge generating material, a hole transport material, a first electron transport material represented by the following formula (1), and a second electron transport material represented by the following formula (2), (1)

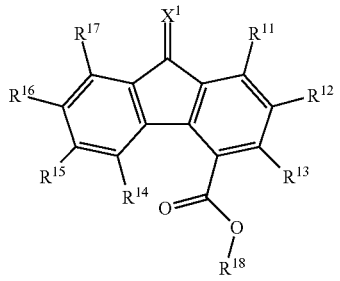

wherein $X^1$ represents an oxygen atom or $=C(CN)_2$; $R^{11}$, $R^{12}$, $R^{13}$, $R^{14}$, $R^{15}$, $R^{16}$, and $R^{17}$ independently represents a hydrogen atom, a halogen atom, an alkyl group, an alkoxy group, an aryl group, or an aralkyl group; and $R^{18}$ represents an alkyl group, $-L^{111}-O-R^{112}$, an aryl group, or an aralkyl group; provided that $L^{111}$ represents an alkylene group, and $R^{112}$ represents an alkyl group, (2)

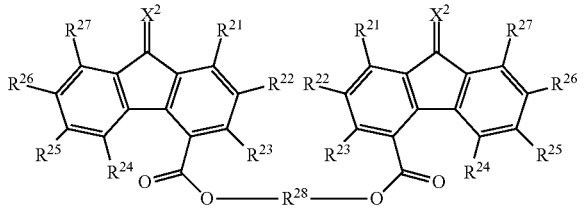

wherein $X^2$ represents an oxygen atom or $=C(CN)_2$; each of $R^{21}$, $R^{22}$, $R^{23}$, $R^{24}$, $R^{25}$, $R^{26}$, and $R^{27}$ independently represents a hydrogen atom, a halogen atom, an alkyl group, an alkoxy group, an aryl group or an aralkyl group; and $R^{28}$ represents an alkylene group having 4 to 20 carbon atoms or $-(L^{221}-O-L^{221})_n-$; provided that $L^{221}$ each independently represents an alkylene group having 1 to 4 carbon atoms and n represents an integer of 1 to 10.

2. The electrophotographic photoreceptor according to claim 1, wherein, in the formula (1), $R^{18}$ is an aryl group substituted with an alkyl group or an alkoxy group.

3. The electrophotographic photoreceptor according to claim 1, wherein, in the formula (2), $R^{28}$ is a linear or branched alkylene group having 6 to 12 carbon atoms.

4. The electrophotographic photoreceptor according to claim 1, wherein, in the formula (2), $R^{28}$ is a group represented by $-(L^{221}-O-L^{221})_n-$, $L^{221}$ each independently is an alkylene group having 1 to 4 carbon atoms, and n is an integer of 1 to 5.

5. The electrophotographic photoreceptor according to claim 1, wherein the amount of the first electron transport material represented by the formula (1) in the photosensitive layer is in a range of 1% by weight to 25% by weight in terms of the ratio of the solid content in the photosensitive layer.

6. The electrophotographic photoreceptor according to claim 1, wherein the amount of the second electron transport material represented by the formula (2) in the photosensitive layer is in a range of 1% by weight to 25% by weight in terms of the ratio of the solid content in the photosensitive layer.

7. The electrophotographic photoreceptor according to claim 1, wherein the amount of the first electron transport material represented by the formula (1) in the entire photosensitive layer is in a range of 1% by weight to 25% by weight in terms of the ratio of the solid content in the photosensitive layer and the amount of the second electron transport material represented by the formula (2) in the photosensitive layer is in a range of 1% by weight to 25% by weight in terms of the ratio of the solid content in the photosensitive layer.

8. The electrophotographic photoreceptor according to claim 1, wherein the amount of all the electron transport materials in the photosensitive layer is in a range of 2% by weight to 30% by weight in terms of the ratio of the solid content in the photosensitive layer.

9. The electrophotographic photoreceptor according to claim 1, wherein the content ratio of the first electron transport material to the second electron transport material (the first electron transport material/the second electron transport material) in the photosensitive layer is in a range of 1/10 to 10/1 in terms of the weight ratio.

10. The electrophotographic photoreceptor according to claim 1, wherein the content ratio of the first electron transport material to the second electron transport material (the first electron transport material/the second electron transport material) in the photosensitive layer is in a range of 1/4 to 5/1 in terms of the weight ratio.

11. The electrophotographic photoreceptor according to claim 1, wherein the content ratio of the first electron transport material to the second electron transport material (the first electron transport material/the second electron transport material) in the photosensitive layer is in a range of 3/7 to 7/3 in terms of the weight ratio.

12. A process cartridge comprising:

the electrophotographic photoreceptor according to claim 1, wherein the process cartridge is detachable from an image forming apparatus.

13. An image forming apparatus comprising:

the electrophotographic photoreceptor according to claim 1;

a charging unit that charges a surface of the electrophotographic photoreceptor;

an electrostatic latent image forming unit that forms an electrostatic latent image on the surface of the charged electrophotographic photoreceptor;

a developing unit that develops the electrostatic latent image formed on the surface of the electrophotographic photoreceptor by a developer containing a toner to form a toner image; and a transfer unit that transfers the toner image to the surface of a recording medium.

14. An electrophotographic photoreceptor comprising:

a conductive substrate; and a photosensitive layer that is a single layer type photosensitive layer provided on the conductive substrate, wherein the photosensitive layer includes a binder resin, a charge generating material, a hole transport material, a first electron transport material represented by the following formula (1), and a second electron transport material represented by the following formula (2), (1)

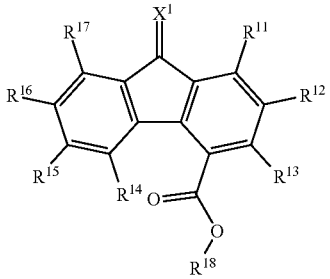

wherein $X^1$ represents an oxygen atom or $=C(CN)_2$; $R^{11}$, $R^{12}$, $R^{13}$, $R^{14}$, $R^{15}$, $R^{16}$, and $R^{17}$ independently represents a hydrogen atom, a halogen atom, an alkyl group, an alkoxy group, an aryl group, or an aralkyl group; and $R^{18}$ represents an alkyl group, $-L^{111}-O-R^{112}$, an aryl group, or an aralkyl group; provided that $L^{111}$ represents an alkylene group, and $R^{112}$ represents an alkyl group, (2)

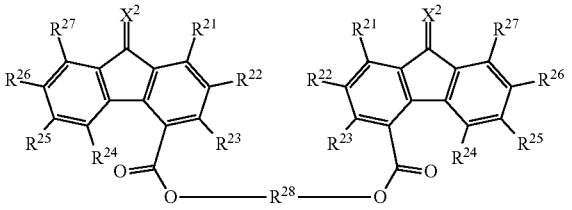

wherein $X^2$ represents an oxygen atom or $=C(CN)_2$; each of $R^{21}$, $R^{22}$, $R^{23}$, $R^{24}$, $R^{25}$, $R^{26}$, and $R^{27}$ independently represents a hydrogen atom, a halogen atom, an alkyl group, an alkoxy group, an aryl group or an aralkyl group; and $R^{28}$ represents an alkylene group having 4 to 20 carbon atoms or $-(L^{221}-O-L^{221})_n-$; provided that $L^{221}$ each independently represents an alkylene group having 1 to 4 carbon atoms and n represents an integer of 1 to 10, and wherein $X^1$, $R^{11}$, $R^{12}$, $R^{13}$, $R^{14}$, $R^{15}$, $R^{16}$, and $R^{17}$ in the formula (1) are the same as $X^2$, $R^{21}$, $R^{22}$, $R^{23}$, $R^{24}$, $R^{25}$, $R^{26}$, and $R^{27}$ in the formula (2), respectively.

* * * * *